US007819789B2

(12) United States Patent
Berman et al.

(10) Patent No.: US 7,819,789 B2
(45) Date of Patent: Oct. 26, 2010

(54) EXERCISE HANDLE AND METHODS OF USE

(75) Inventors: David Berman, Golden, CO (US); Lee F. Spieker, Littleton, CO (US)

(73) Assignee: TherapyZone, Inc., Denver, CO (US)

( * ) Notice: Subject to any disclaimer, the term of this patent is extended or adjusted under 35 U.S.C. 154(b) by 338 days.

(21) Appl. No.: 11/231,584

(22) Filed: Sep. 20, 2005

(65) Prior Publication Data

US 2006/0063652 A1 Mar. 23, 2006

Related U.S. Application Data

(60) Provisional application No. 60/611,445, filed on Sep. 20, 2004, provisional application No. 60/671,346, filed on Apr. 13, 2005.

(51) Int. Cl.
*A63B 21/00* (2006.01)

(52) U.S. Cl. ..... 482/126; 482/121; 482/123

(58) Field of Classification Search ..... 482/49, 482/139, 44, 907, 121, 126, 146, 91, 123; 72/459, 458, 457
See application file for complete search history.

(56) References Cited

U.S. PATENT DOCUMENTS

| | | | | | |
|---|---|---|---|---|---|
| D111,870 | S | * | 10/1938 | Benfeild | D8/32 |
| 2,804,791 | A | * | 9/1957 | Wheeler | 72/459 |
| 3,677,543 | A | | 7/1972 | Richardson | |
| 4,269,056 | A | * | 5/1981 | Kozinski | 72/459 |
| 4,452,064 | A | * | 6/1984 | Custin | 72/459 |
| 4,461,473 | A | | 7/1984 | Cole | |
| 4,544,155 | A | | 10/1985 | Wallenbrock et al. | |
| 4,629,184 | A | | 12/1986 | Selkee | |
| 4,822,035 | A | | 4/1989 | Jennings et al. | |
| 4,951,956 | A | | 8/1990 | Vittone | |
| D316,658 | S | * | 5/1991 | Wanner et al. | D8/14 |
| 5,087,031 | A | | 2/1992 | Hoff | |
| D328,112 | S | | 7/1992 | Maddix et al. | |
| 5,176,602 | A | | 1/1993 | Roberts | |
| 5,312,309 | A | | 5/1994 | Fox | |
| 5,334,113 | A | | 8/1994 | Roepke | |
| 5,352,174 | A | | 10/1994 | Mason et al. | |
| 5,399,133 | A | | 3/1995 | Haber et al. | |
| 5,407,405 | A | | 4/1995 | Oren | |
| 5,498,223 | A | | 3/1996 | Iams et al. | |
| 5,681,248 | A | | 10/1997 | Vani | |
| 5,709,637 | A | * | 1/1998 | Gow et al. | 482/129 |

(Continued)

FOREIGN PATENT DOCUMENTS

| | | |
|---|---|---|
| JP | 11220985 A | 8/1999 |

(Continued)

*Primary Examiner*—Jerome Donnelly
(74) *Attorney, Agent, or Firm*—Hensley Kim & Holzer, LLC

(57) ABSTRACT

An exercise handle for use with a cord and a method for the use thereof, the handle having a channel portion having at least two channel ends that are positioned non-diametrically relative to each other on the channel portion, the channel portion being rounded relative to a center point; a channel being fashioned on the channel portion, the channel being adapted to receive the cord; a grip portion being positioned between the at least two channel portion ends in an off-center relationship to the center point of the channel portion.

27 Claims, 34 Drawing Sheets

U.S. PATENT DOCUMENTS 5,718,654 A 2/1998 Kennedy
5,730,689 A 3/1998 Haugen
5,894,631 A 4/1999 Chiu
5,993,362 A * 11/1999 Ghobadi ..... 482/124
6,093,136 A 7/2000 Whipple
6,105,891 A 8/2000 Ikuta et al.
6,264,589 B1 7/2001 Chen
6,446,483 B1 * 9/2002 Ericksen ..... 72/459
6,569,066 B1 5/2003 Patterson et al.
6,652,420 B2 11/2003 Chen
6,663,544 B2 12/2003 Hinds
6,866,617 B2 * 3/2005 Chen ..... 482/124
2003/0083178 A1 5/2003 Gilman
2004/0152569 A1 8/2004 Lerner

FOREIGN PATENT DOCUMENTS

JP 2002301170 A 10/2002

* cited by examiner

EXERCISE HANDLE AND METHODS OF USE

CROSS-REFERENCE TO RELATED APPLICATIONS

This application claims the benefit of the prior filed provisional applications, U.S. No. 60/611,445, filed Sep. 20, 2004 and U.S. No. 60/671,346, filed Apr. 13, 2005. These provisional applications are incorporated herein for all that they teach and disclose.

TECHNICAL FIELD

The technology here relates generally to exercise and therapy equipment, and more particularly to a handle for use with such equipment and for exercise and therapy.

BACKGROUND

Many exercises and varieties of exercise equipment have been developed using elastic tubing, rubber bands, cords, chains, cables, ropes, and bungee cords (collectively and separately also referred to hereinafter as "cords"). For example, it is common for a user to attach one end of a cord to a handle and the other end of the cord to a floor anchor, a wall anchor, a ceiling anchor, etc. The anchor may be stationary, particularly in the case of an elastic cord, but the anchor may also be movable, such as involving a pulley and/or being attached to a set of movable weights. However, in existing approaches, the handle attached to the non-anchored end is not structurally optimized to maximize the resistance during a range of motion while reducing certain negative compressive forces.

In addition, in existing approaches, different pieces of exercise equipment are designed for different exercises. For example, to exercise the wrist, a user might require several difference pieces of exercise equipment to allow for performance of the following standard exercises: wrist flexion; wrist extension; wrist radial deviation; wrist ulnar deviation; supination; pronation; and, gripping/hand closing. Requiring many different pieces of exercise equipment is a costly approach for users in a training or physical therapy scenario.

SUMMARY

An improved exercise handle is described herein. In one set of implementations, an exercise handle for use with a cord and methods for the use thereof are set forth, the handle having a channel portion having at least two channel ends that are positioned non-diametrically relative to each other on the channel portion, the channel portion being rounded relative to a center point; a channel being fashioned on the channel portion, the channel being adapted to receive the cord; a grip portion being positioned between the at least two channel portion ends in an off-center relationship to the center point of the channel portion.

In another implementation, set forth is a cord lock for use with a cord and an exercise handle, the cord lock including: a ball portion having a textured surface for engaging the cord in a frictional manner relative to the exercise handle and thereby lock the cord relative to the handle.

DESCRIPTION OF THE DRAWINGS

FIG. 12, which includes sub-part

DETAILED DESCRIPTION

An improved exercise handle is described herein. In one implementation, an elastic tube is secured to the exercise handle, which increases and manages the torque over existing approaches by lengthening the moment arm between the user's grip and the force applied by the elastic tube. Accordingly, the handle allows certain exercises to be performed with effective tension that existing handles do not support. Clinically, the use of the improved exercise handle presents an opportunity for more effective therapeutic exercises. The handle allows for improved resistance in a larger and more diverse pool of exercises, while requiring the use of only a single handle device.

The handle can also support complex/compound exercises that require resistance in more than one plane (i.e. a biceps curl composed of elbow flexion and forearm supination). With traditional handles and weights, the supination component is left substantially un-resisted. With the handle apparatus hereof, the exercise can be performed with biomechanical integrity.

Figure 1:
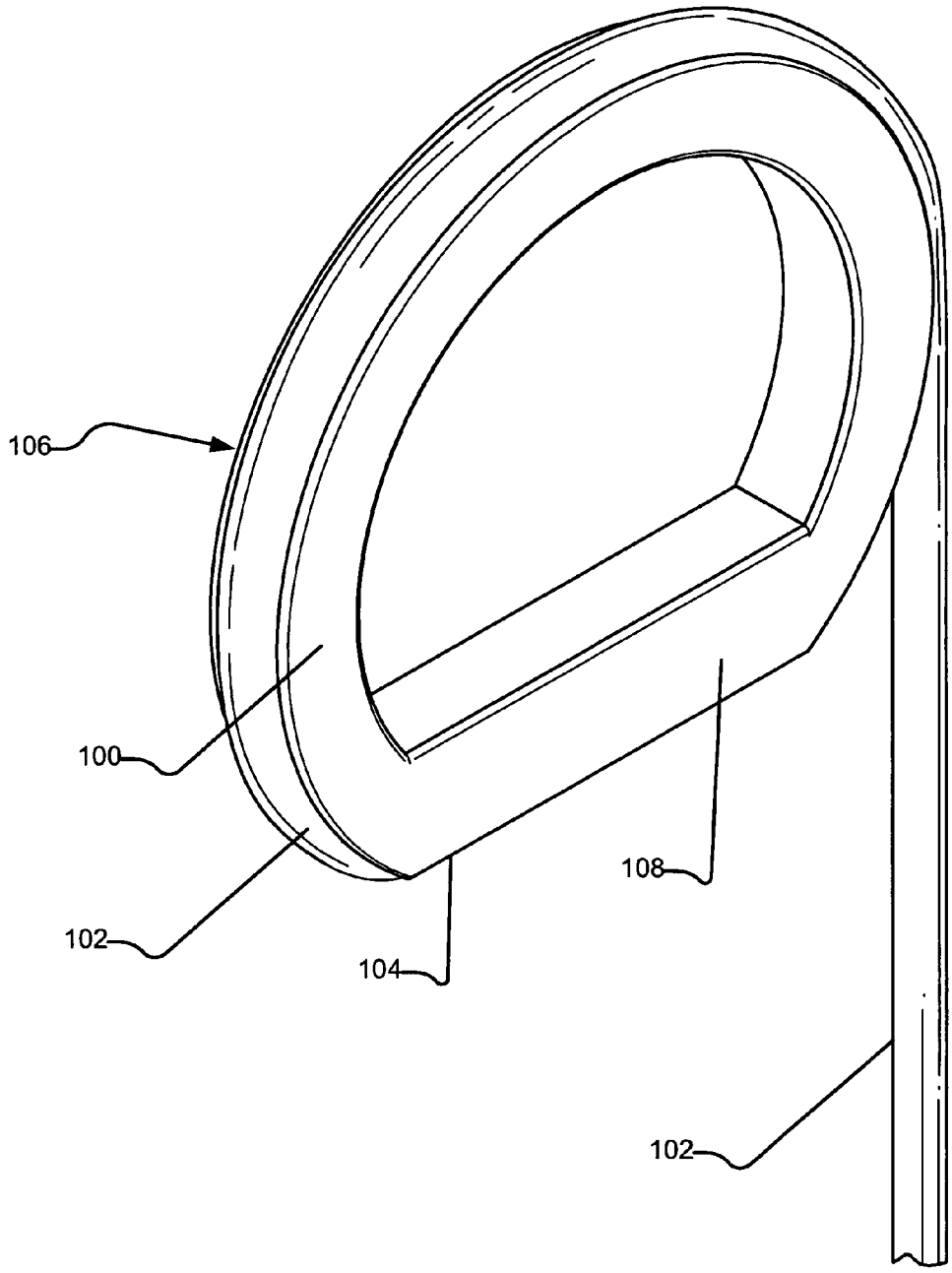
FIG. 1 is an isometric view of an exercise handle hereof.

Some exemplary handles shapes according hereto are shown in FIGS. 1-15, although other shapes and configurations are also contemplated. Detailed sets of drawings of exemplary designs are shown in the respective implementations of FIGS. 1-15. For a first example, FIG. 1 illustrates an implementation of an exercise handle device 100 (also referred to merely as a "handle" herein) wherein an elastic resistance tube 102 (or other cord as defined herein and/or as understood in the art) is attached to an anchor (e.g., another handle, see below, or to a weight or weights or to a wall or a door, not directly shown) on one end and an attachment point 104 in/on the handle 100 on the other end. During use, the tube 102 wraps around the handle 100 in a channel 106 (which is obscured by the tube 102). The attachment point 104 is formed into a grip portion 108 of the handle 100, although alternative locations are contemplated (see below). Note the channel 106 has two ends, between which the grip portion 108 is defined. Also, the circumference of the rounded channel portion of the handle 100 defines a center (e.g., by rotation of a radius from the circular or rotational center along the rounded channel portion of the handle device), the grip 108 in many implementations being in an off-center relationship with, or otherwise not being on or running through the center point of the defined center of the channel portion.

Figure 2:
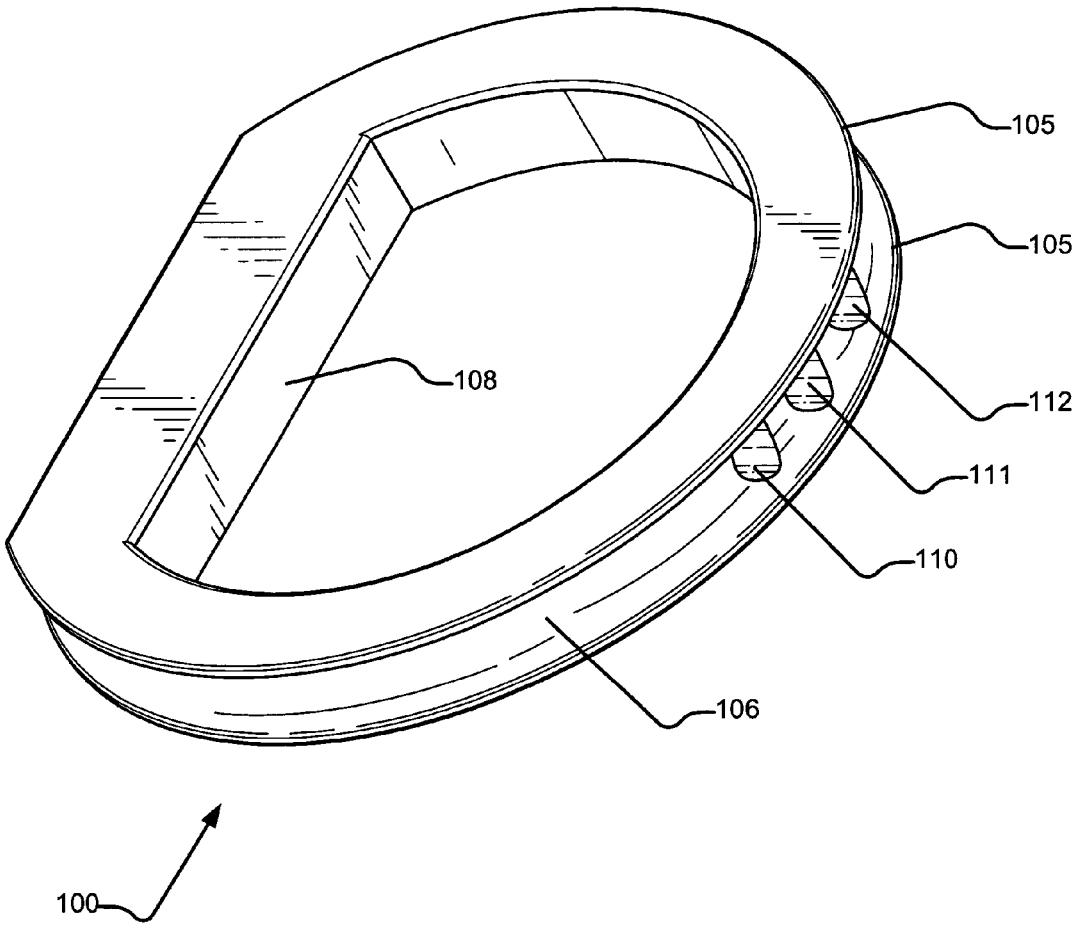
FIG. 2 is another isometric view of the exercise handle of FIG. 1.

FIG. 2 provides another detailed view of the first exemplary exercise handle 100. The channel 106 is located along at least a portion of the handle 100. The channel 106 is defined by two channel lips 105 and here a rounded internal channel surface 106. As shown, the two lips 105 and 105 on either side of the channel surface are the same height relative to the channel surface 106. The circumference of the rounded handle portion of the handle 100 defines a center (e.g., by rotation of a radius from the center along the circumference).

A cord 102 (elastic or not—not shown in FIG. 2) is to be attached to the handle 100 at an attachment point 104 within the grip portion 108 and laid along the channel 106. In various exercises, the cord is pulled along the channel 106 against the resistance of an anchor point (not shown) at the other end of the cord. It should be understood that the attachment point for the cord may be recessed into the attachment point 104 in the grip 108 or to another attachment point, such as a fixture attached to the grip 108. A series of holes 110, 111 and 112 are shown, these holes having a few alternative uses (see below descriptions, e.g., to provide for stirrup connection of the cord or to a support fixture of a rod, inter alia).

Figure 3:
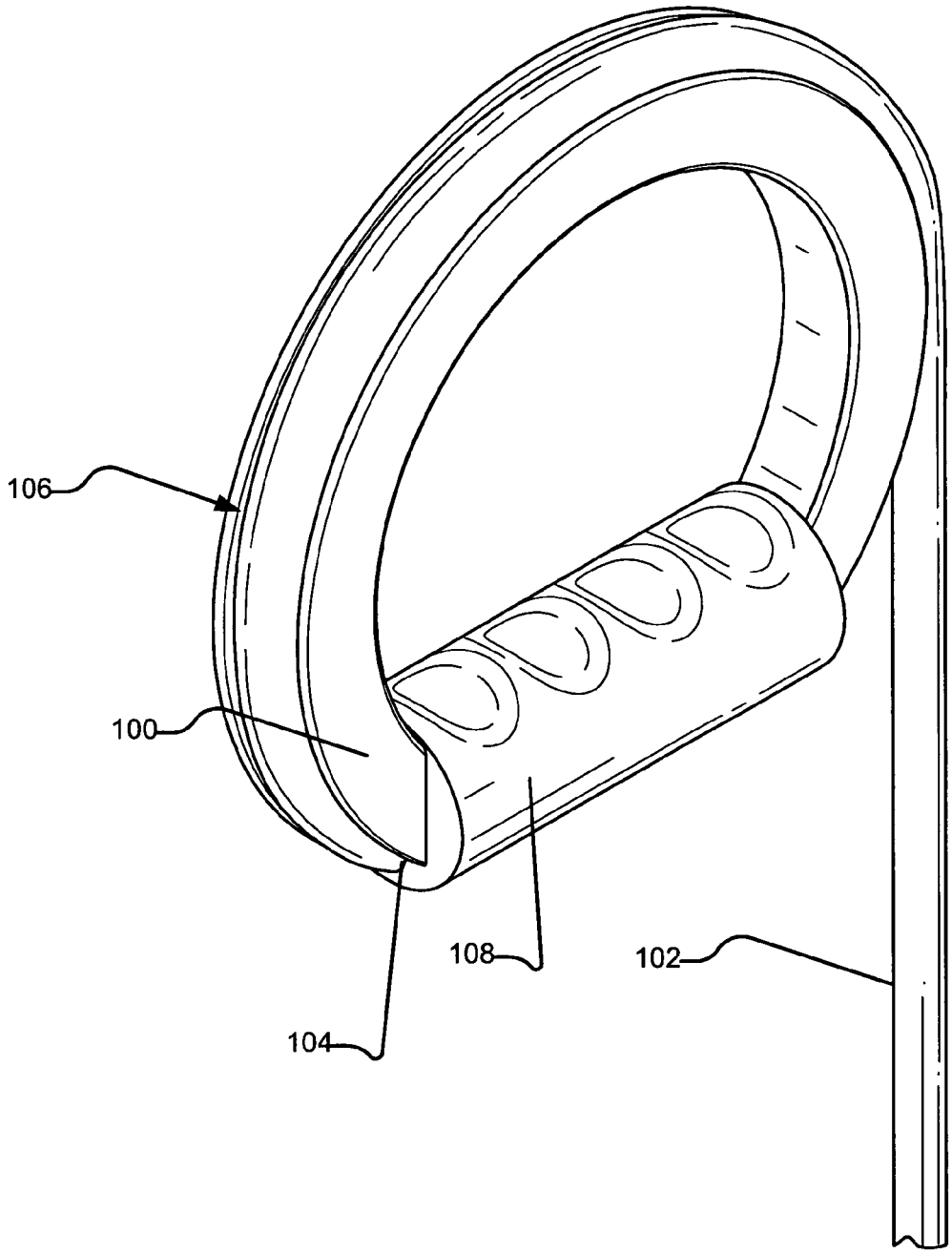
FIG. 3 is an isometric view of another exercise handle hereof.
Figure 4:
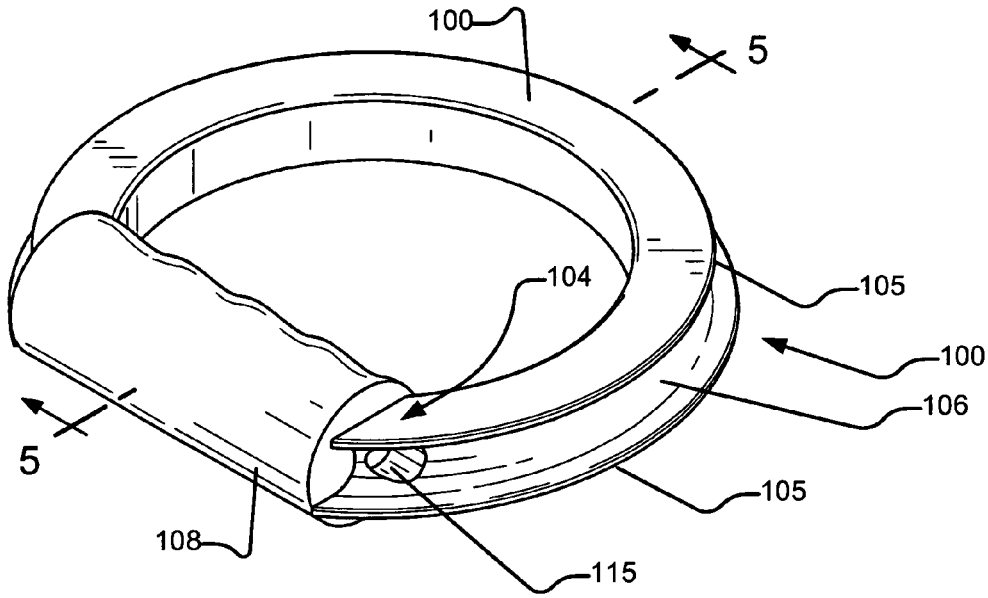
FIG. 4 is a further isometric view of the exercise handle of FIG. 3.
Figure 5:
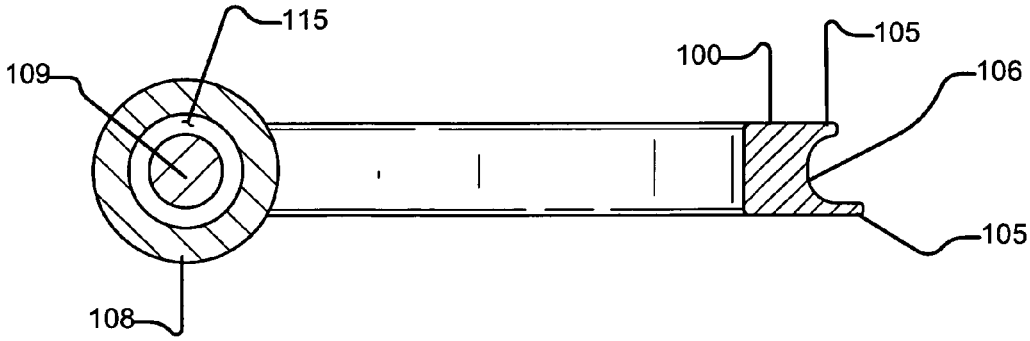
FIG. 5 is a cross-sectional view of the exercise handle of FIG. 4 taken along line 5-5 thereof.

FIGS. 3-5 illustrate an alternative exemplary exercise handle 100 also according hereto. FIGS. 3 and 4 illustrate with this other implementation where an elastic tube 102 may be attached to an anchor (e.g., a wall—not shown) on one end and to an attachment point 104 in the handle 100 on the other end. During use, the tube wraps around the handle 100 within the channel 106. The attachment point 104 is within the hollowed portion 115 of a hollow grip portion 108 of the handle device 100. In the illustrated implementation, the tube 102 is inserted in and through the hollow 115 of the grip portion 108 and frictionally anchored therein using a stopper component 109 (shown in FIGS. 5 and 6) which frictionally engages the tube within the hollow opening 115 in the grip 108. Note, the stopper component as shown in FIG. 5 is smaller than the hollow portion 115 of the grip 108, but is large enough that it will bear substantially against any other member disposed within the hollow portion, thus against a tubing or other cord member within the hollow portion and thus coact with the inner wall of the hollow portion 115 to hold the tubing in place therein. However, it should be understood that other anchoring mechanisms and configurations may be employed, as for example, using cork-like stopper (not shown) disposed within the end of the tube 102, such that the stopper component and tube 102 can be held stationary like a wine bottle cork.

In a particular implementation of using a ball lock hereof (see FIG. 6), the tube should be inserted completely through the hollow portion of the handle's grip so the tube exits the end where the ball portion of the ball lock is located. Preferably, at least one or more inches (e.g., 3") may be left visible (see FIG. 6), then the ball is pressed into the hollow portion of the grip while pulling on the tube on the opposite end. This will lock the tube in place. To release, the extending end portion of the tube is pulled in the opposite direction to release the ball lock.

As mentioned, a cord 102 (elastic or not—not shown) is to be attached to the handle at an attachment point 104 and laid along the channel 106. In various exercises, the cord is pulled along the channel 106 against the resistance of an anchor point (not shown) at the other end of the cord. The attachment point for the cord may be recessed into the hollow portion 115 in the grip portion 108 or to another attachment point, such as a fixture attached to the grip portion 108 (see alternative described below). In the hollow portion form of cord attachment, the handle may be adjustably and detachably connected to the cord by the reeving of the free end of the cord in and through an aperture defined in and through the handle and frictionally retained therein. In some such cases, a plug attached to a pull handle may be frictionally inserted in the aperture adjacent the cord, the plug frictionally bearing upon the cord and securing the cord to and within the handle. Even so, the frictional bearing of the plug on the cord may have alternative implementations. Different materials of cord and/or plug can and will present distinctive quantities of frictional retention. Requiring many different types of material plugs or different locks for cord-based exercise equipment is a costly approach for users in a training or physical therapy scenario.

A textured cord lock for a cord-based exercise handle may alternatively be used in many implementations where an elastic tube or other exercise cord is anchored to and/or within the exercise handle.

Figure 6:
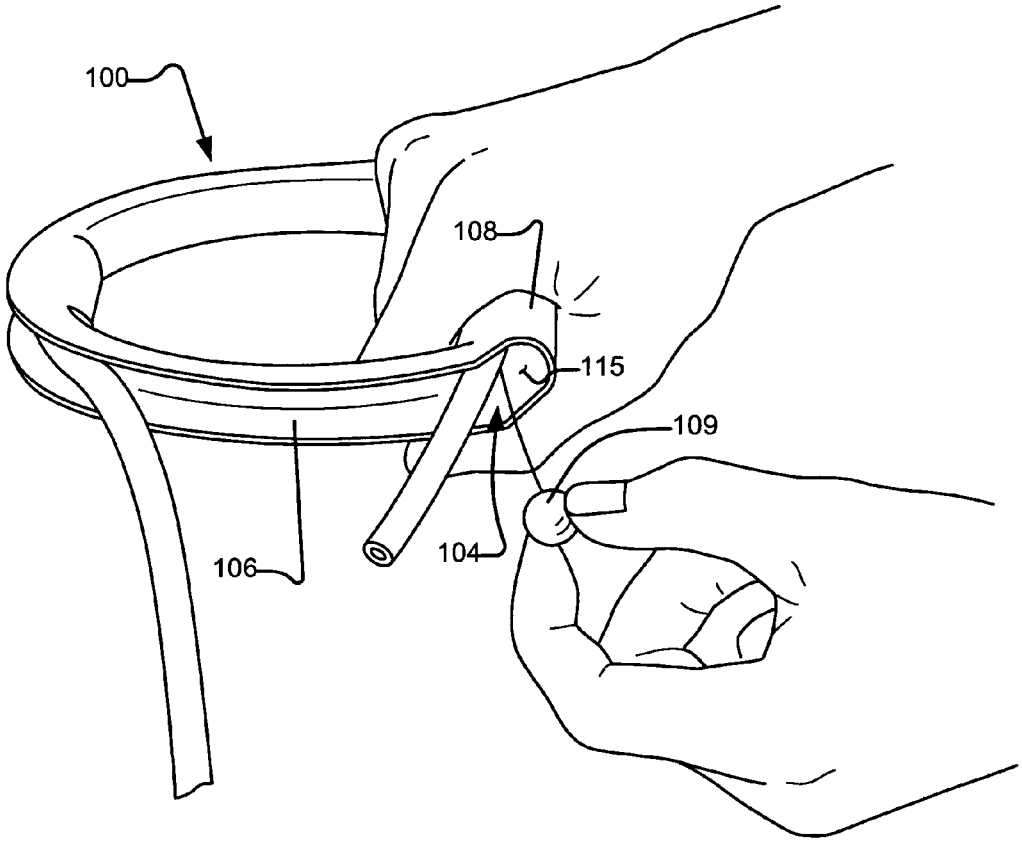
FIG. 6 is an isometric view of yet one further exercise handle hereof.
Figure 7:
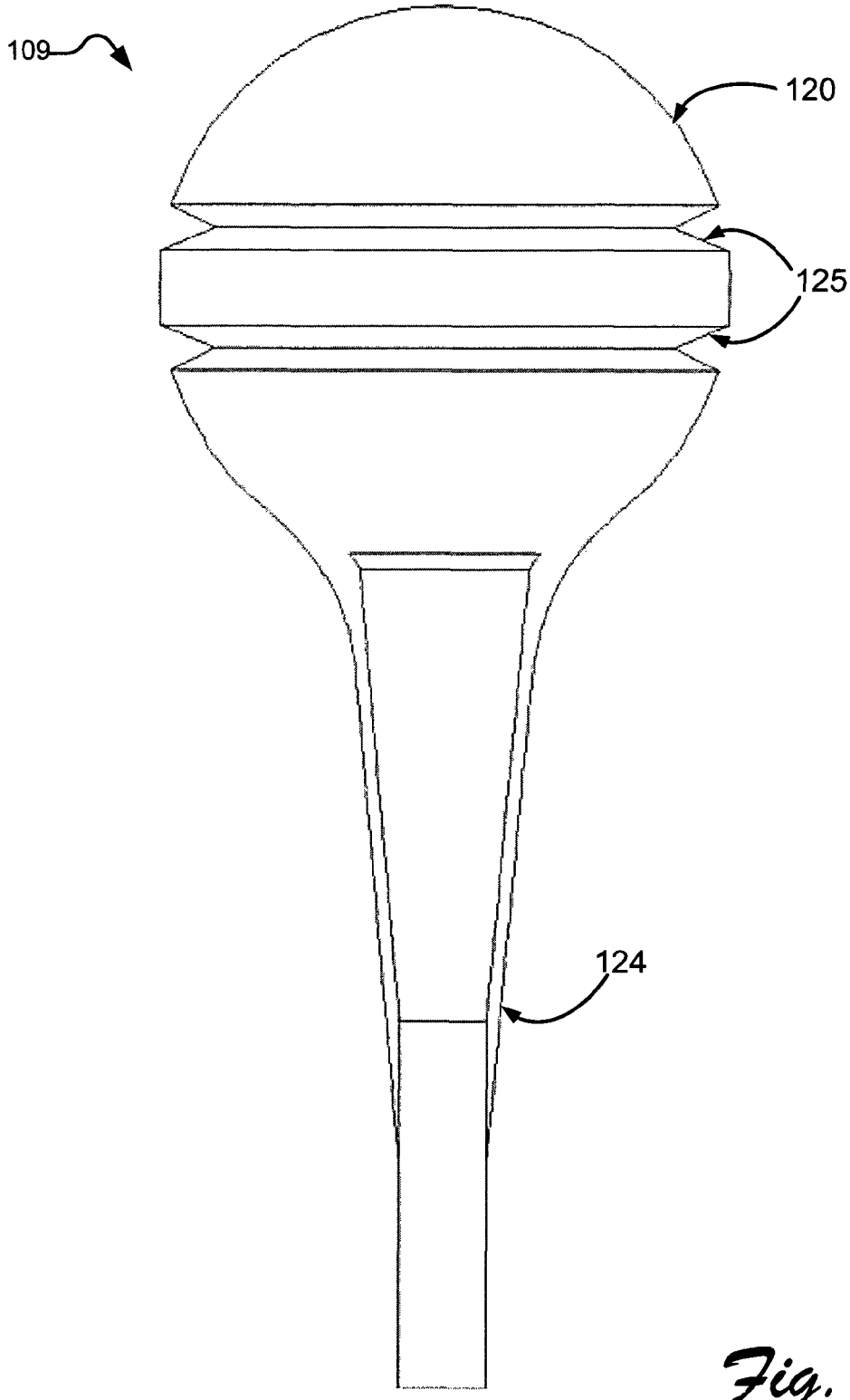
FIG. 7 is an elevational view of a cord lock hereof.

In particular, the cord lock shown in FIG. 6 is referred to generally using the reference numeral 109, and is shown in a textured ball implementation in FIG. 7. In FIG. 7, the ball lock 109 is shown including a plug or ball portion 120 with an elongated portion 124 extending generally therefrom. The elongated tether portion 124 can extend to a T-shaped pull member (not shown) for human manipulation of the ball lock into place within the hollow portion 115 of the grip 108. The textured portion of the cord lock 109 here includes a pair of grooves 125 formed or defined in the ball portion 120.

Figure 8:
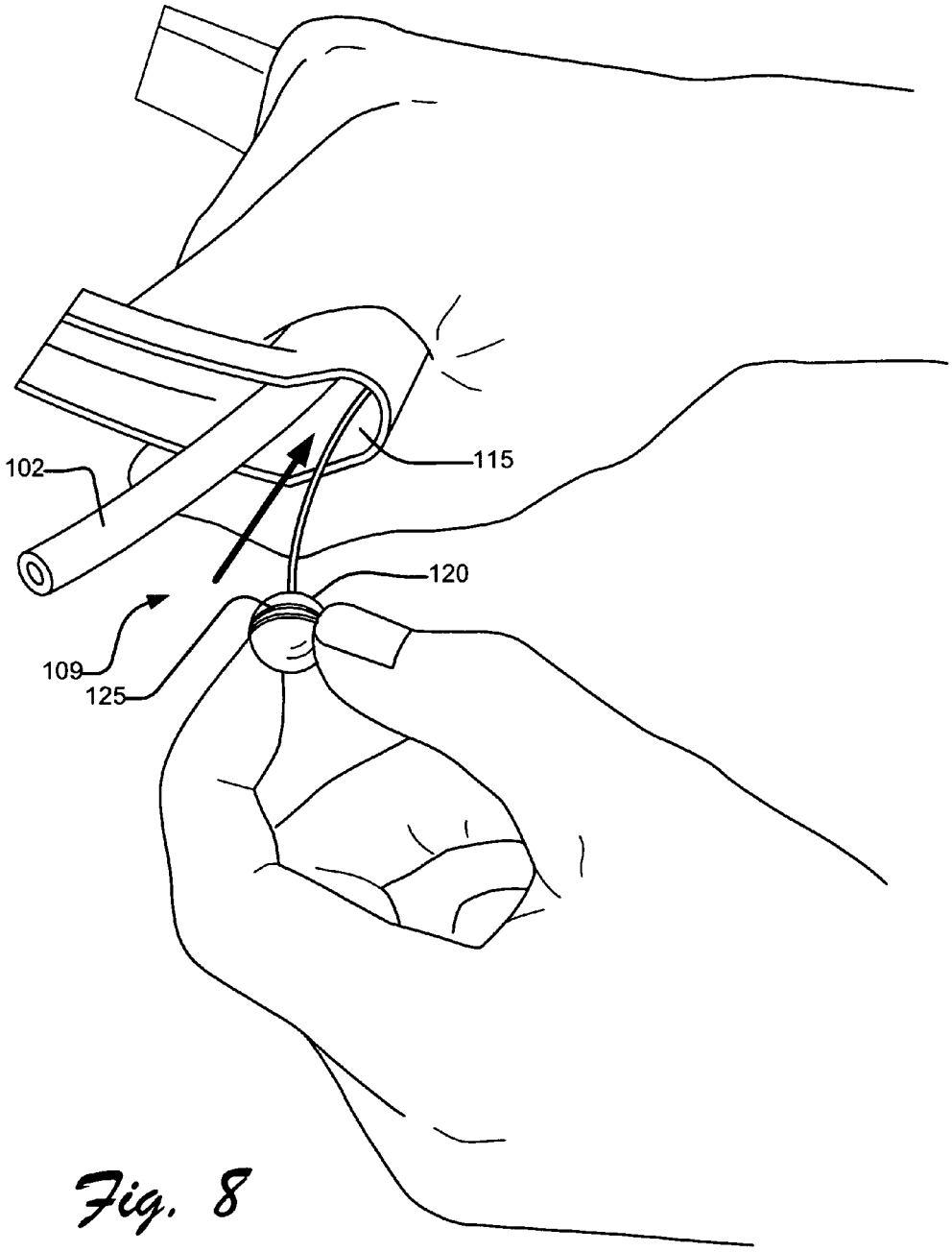
FIG. 8 is an isometric view of a handle, cord and cord lock hereof.

The textured portion 125 of the cord lock 109 provides for better frictional engagement with a cord as may be seen in FIG. 8. Here, a cord lock 109 is shown in use with an exercise handle which has a cord 102 reeved into and through an aperture 115 defined therein. In FIG. 8, the cord lock 109 is disposed extending out of the aperture and is not engaged with the cord 102. However, as shown by the arrow, the cord lock 109 will be manipulated and moved into the aperture 115 to engage the cord 102 within the aperture 115. Though not shown, the aperture will have a diameter which is small enough at some point therein to not allow for the movement of the cord lock and the cord therethrough simultaneously. At this point the cord lock can bind the cord and restrain the cord from moving, thus locking it in place. The grooves 125 or other texturing on the ball 120 may engage the cord 102 to provide greater frictional resistance to movement of the cord 102.

Various alternative embodiments of cord and/or cord locks and textured features may be used in accordance herewith. Thus, although an elastic resistance tube is described often herein, it should also be understood that the elastic tube may be replaced with other elastic or non-elastic cords, such as a chain or rope. In some implementations, the distal end of the cord may be anchored to a spring mechanism, a movable weight mechanism, or another elastic or movable anchor mechanism. One or more pulleys may also be used. Thus, although the cord 102 may typically be elastic resistance tubing, in many weight related implementations, a nylon braided threaded rope, however, other materials of rope or like threaded material may be used instead; as for example including polypropylene, PVC and cotton. With rope like cords, deep multiple grooves 125 may be preferred for the capability of providing high frictional grip of the ball 120 into the cord 102, rather like biting into the rope material for secure restraint of movement. Note, a single groove 125 may be sufficient or a plurality larger than the two shown may be used as well. With other cord materials, e.g., plastic or rubber tubes, other, perhaps less pronounced (or perhaps even more pronounced) texture forms may be useful. For example, roughened surfaces or dimples or a variety of raised surfaces or protrusions may alternatively be used. A variety of shapes of the "ball" 120 may also be used as in cubical, frusto-pyramidal, frusto-conical or irregular shapes, inter alia. In other words, the "ball" 120 need not be spherical.

Figure 9:
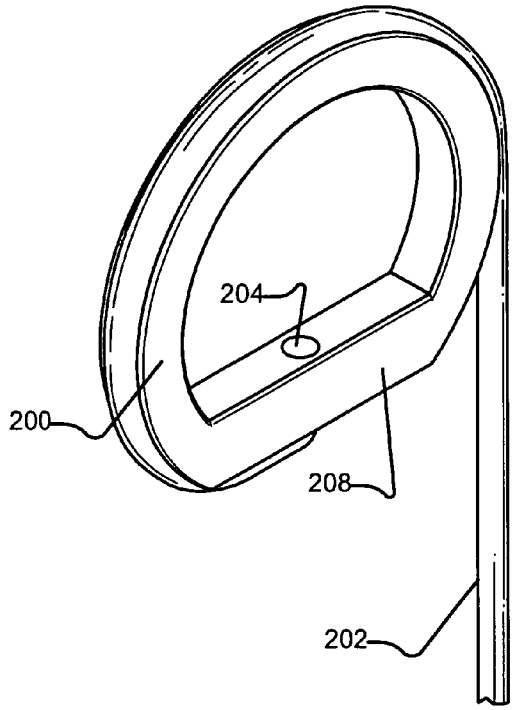
FIG. 9 is an isometric view of still another exercise handle hereof.
Figure 10:
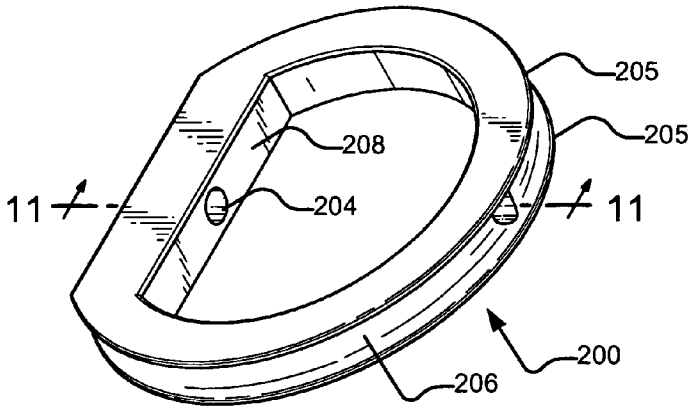
FIG. 10 is a further isometric view of the exercise handle of FIG. 9.
Figure 11:
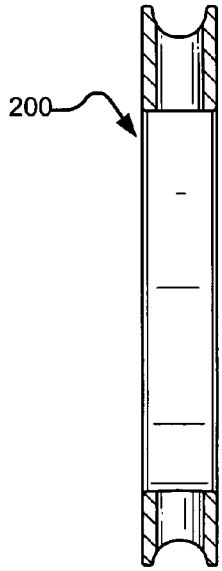
FIG. 11 is a cross-sectional view of the exercise handle of FIG. 10 taken along line 11-11 thereof.

FIGS. 9, 10 and 11 illustrate a detailed drawing of another exemplary exercise handle 200. A channel 206 is located along at least a portion of the handle 200. The channel 200 is defined by two channel lips 205 and a channel surface 206. As shown and as was the case in the examples described above, a grip portion 208 is defined between the two ends of the channel portion 206. Here also the circumference of the rounded handle portion of the handle 200 defines a center (e.g., by rotation of a radius from the center along the rounded handle portion). A distinction here is the attachment point 204 being fixed in the grip portion without there being a hollow portion (like portion 115 above). Rather, the tube 202 is fixed in a hole at the attachment point 204 (as by a cork or like stopper in an elastic tube 202, or by a stopper not unlike the ball 109 shown and described hereabove).

Figure 12A:
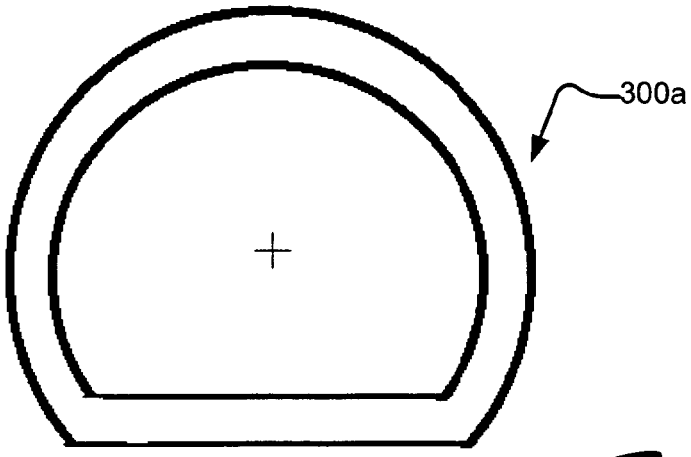
FIGS. 12A, 12B and 12C, depicts alternative handle shapes hereof.
Figure 12B:
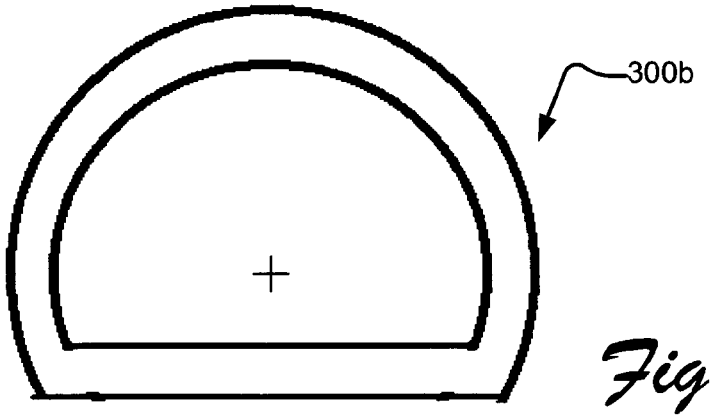
Figure 12C:
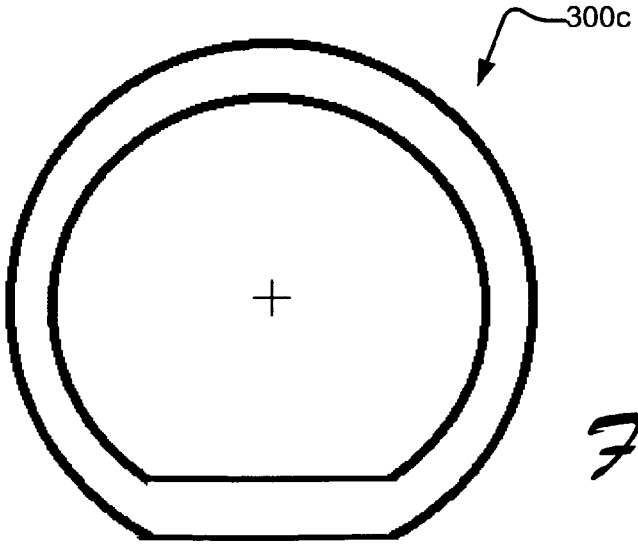
Figure 13:
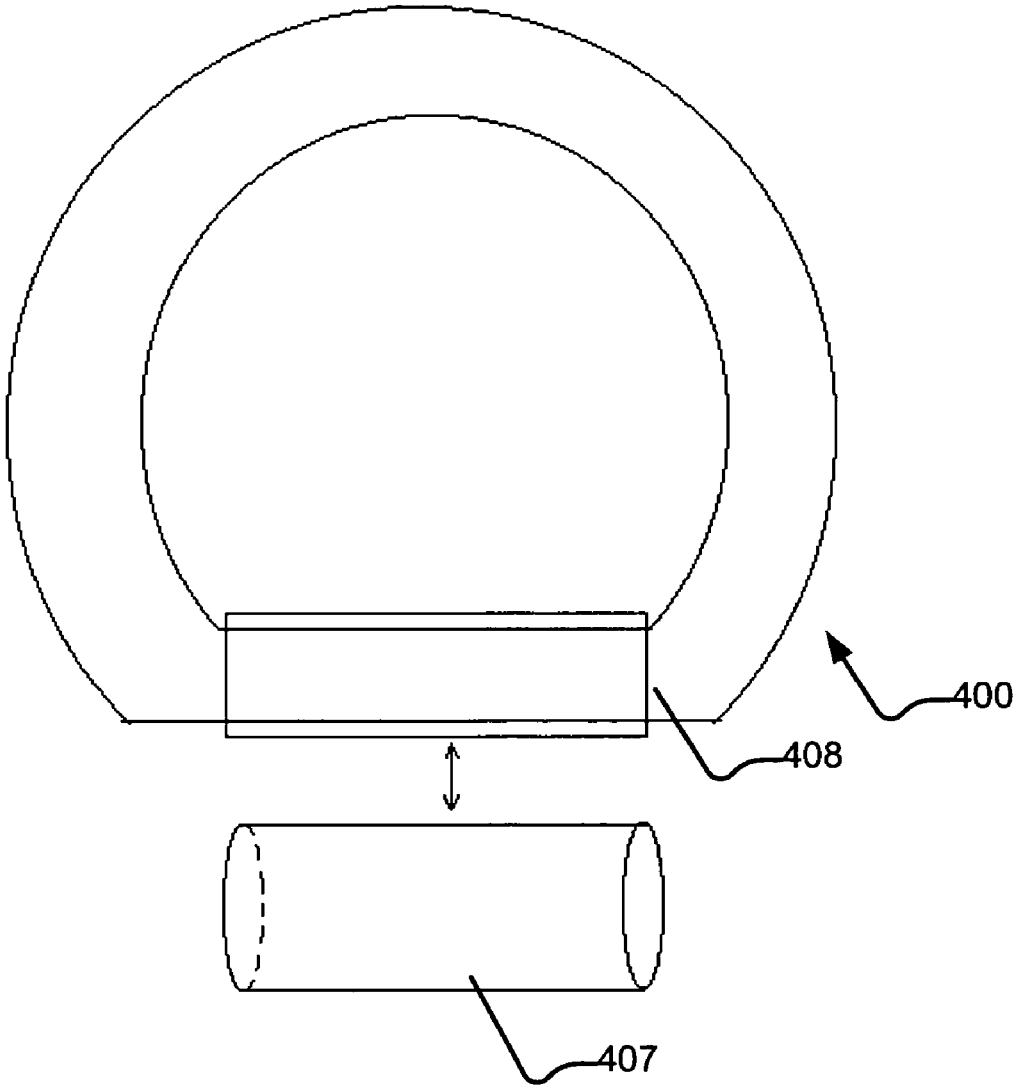
FIG. 13 is an elevational view of another alternative handle hereof.
Figure 14:
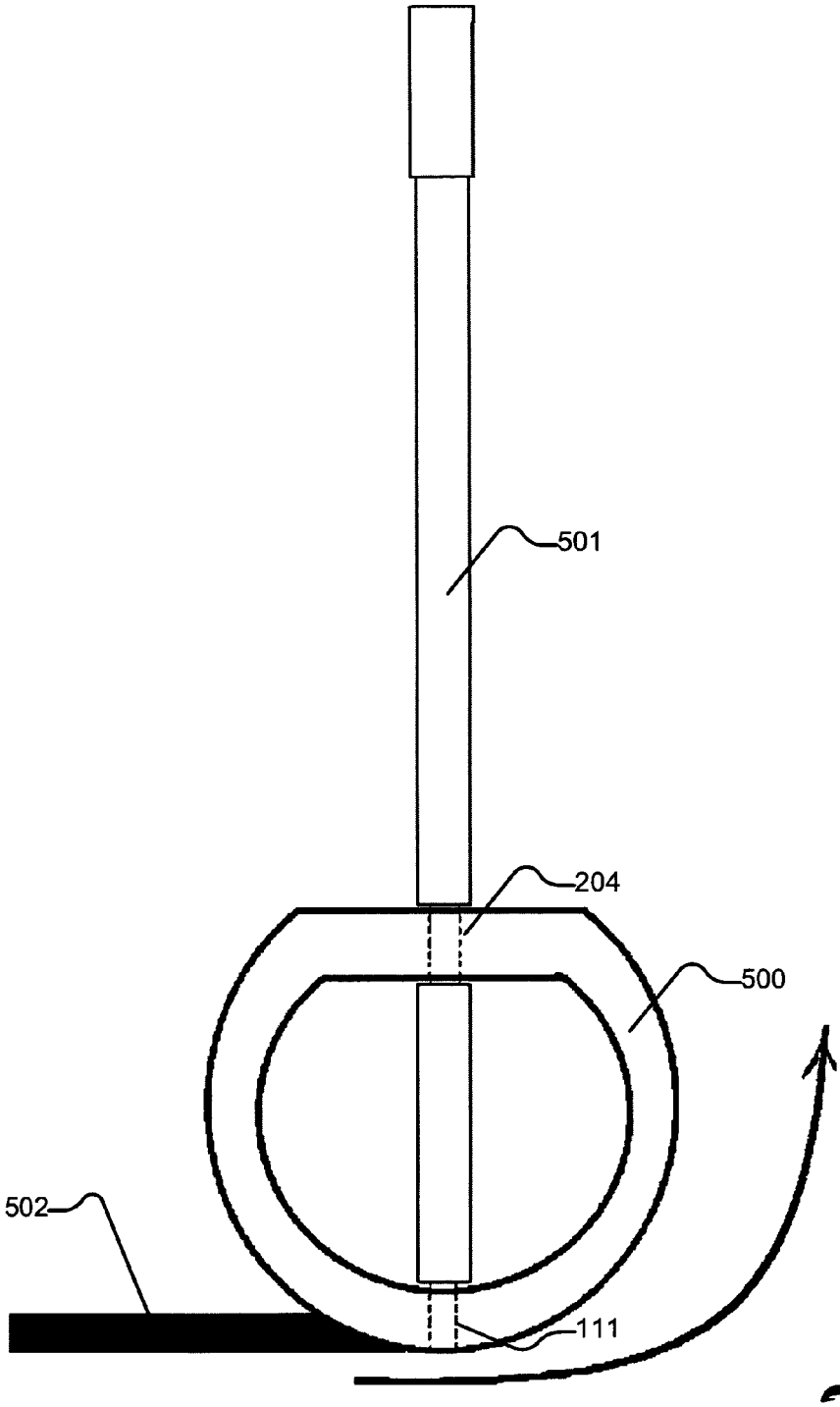
FIG. 14 is an elevational view of still another alternative handle hereof.

Other variations of the handle are also contemplated, including:

A handle with a flat, ribbed, or otherwise non-necessarily rounded or circularly rounded channel—this variation can be used with flat straps, chains, and other cord configurations;

A handle manufactured from wood, injection molded plastic, blow molded plastic, milled steel, cast iron; fiberglass reinforced plastic or other substantially rigid moldable material;

Handles having a variety of different diameters;

Variations in grip portion of handle:

beveled as in gun handle grips, or otherwise for ease in handling (e.g., FIGS. 3-5);

larger or smaller handle portions for greater grip involvement during exercise;

placement of handle relative to the channel ends (e.g. closer to the center line/diameter, or further towards circle's edge) as shown for example by the alternative handles 300 of FIG. 12; i.e., where starting with the reference handle 300*a* of FIG. 12A, the grip has either been moved closer to the center line/point in the handle 300*b* of FIG. 12B and further away from the center point in the handle 300*c* of FIG. 12C;

adding a cylindrical or like floating piece 407 on and/or about the grip portion 408 that allows for gliding of the handle 400 as shown in FIG. 13;

A handle having an alternative locking mechanism for attachment of cord to the handle;

Handles having a variant of different channel depths, non-uniform channel depths (e.g., a gradual decrease in channel depth around the channel circumference can alter the moment arm), an adjustable uniform channel depth, or an adjustable non-uniform channel depth, or as shown in FIG. 5, an alternative where the two lips 105 defining the channel 106 on either side of the channel surface are of different heights relative to the channel surface 106;

A series of holes 110, 111 and 112 as shown in FIG. 2 may be provided for a variety of alternative uses as for example providing, via hole 111 for connection to a support fixture of a rod 501 as in FIG. 14. A handle 500 as in FIG. 14 may be used with rod attachment 501 to provide for long arm use swinging exercises stretching the cord 502, such as may be useful in swinging sports as for example, tennis, golf, baseball. A hole 204 may also be desirable for such a rod-type connection.

Figure 15A:
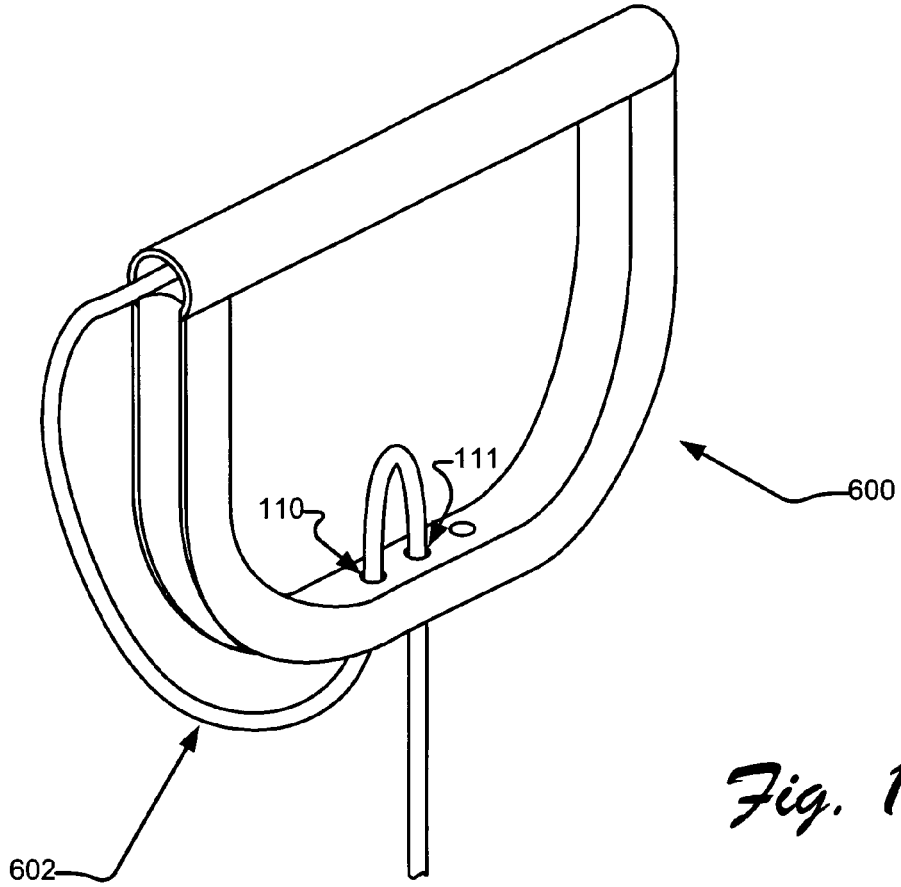
FIG. 15, which includes sub-part FIGS. 15A and 15B, provides isometric views of a further alternative handle hereof.
Figure 15B:
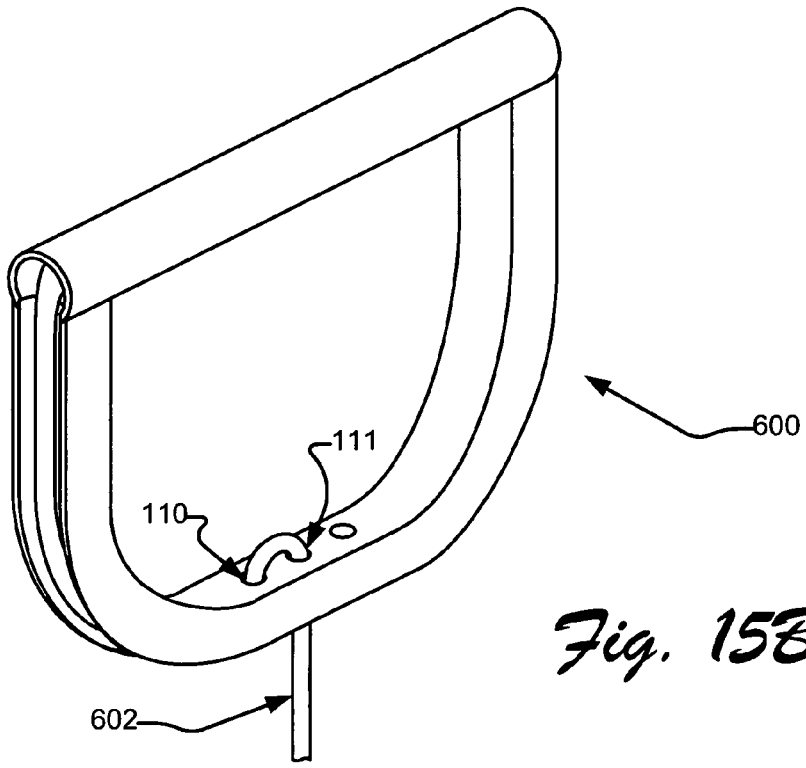

It may be noted that the series of holes 110, 111 and 112 as shown in FIG. 2 may have further alternative uses as for example is shown in FIG. 15 where a cord 602 is shown run through a first of such holes 110 and then into the middle hole 111 for the provision of a stirrup like grip to be used in exercises as described below. In the stirrup grip, the tube is first locked firmly in the hollow portion of the grip with the ball lock, then the tube is inserted into the closest hole in the channel on the handle across from the grip, and then the tube is inserted into the middle hole and pulled down and away from the handle, removing all the slack. This is the traditional Stirrup Grip.

Note, alternative actions are available through the attaching of the tube to the handle hereof. The unique ball lock design of the handle allows for easily adjusting the length of the tube. As the tube is shortened, the resistance level of the tube increases. For lighter resistance, lengthen the tube.

Figure 16:
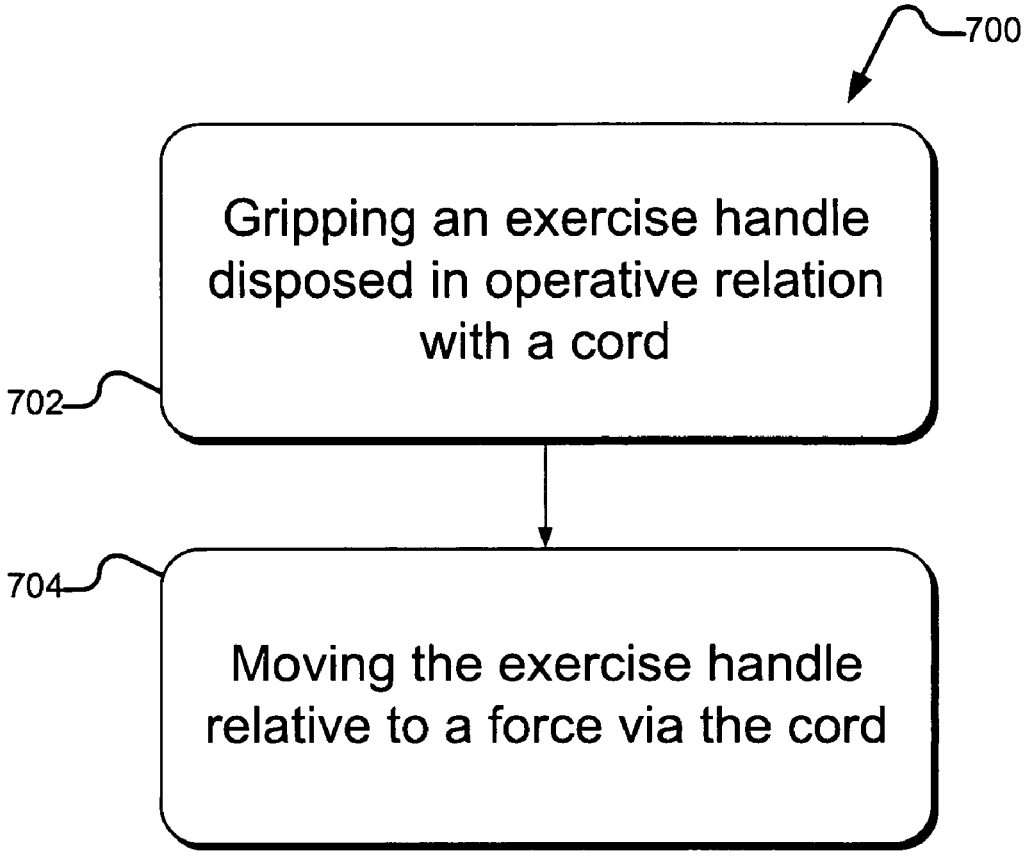
FIG. 16 is a flow chart depicting a method hereof.

In use, Exercise methods hereof may generally include gripping a handle hereof and moving it against or applying a force via a cord attached thereto. A similar method 700 is shown in FIG. 16 including the two basic operations 702 and 704 for gripping the handle and moving the handle relative to a force. In some more detail, the practice of an exercise method employing a cord attached to an anchor may include gripping a grip portion of a handle having a channel portion, the channel portion including at least two channel ends that are non-diametrically positioned on the channel portion, the channel portion being rounded relative to a center point, a channel being fashioned on the channel portion, and adapted to receive the cord, the grip being positioned between the at least two channel ends in an off-center relationship to the center point of the channel portion; and moving the handle to apply force to the anchor via the cord in the channel.

Figure 17A:
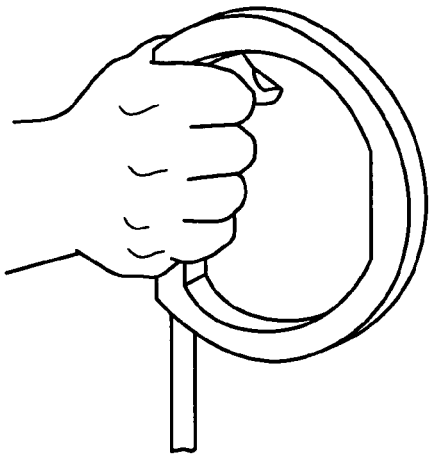
FIG. 17, which includes sub-part FIGS. 17A, 17B and 17C, provides isometric views of alternative uses of a handle hereof.
Figure 17B:
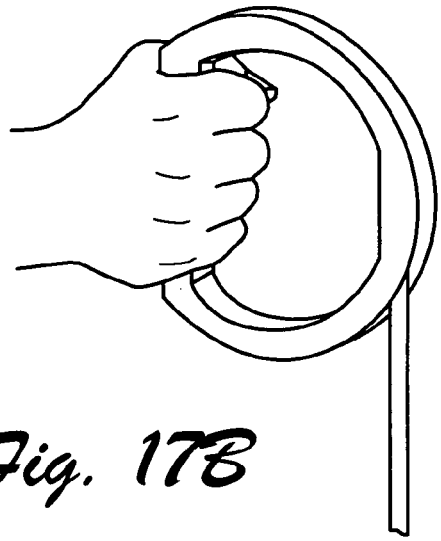
Figure 17C:
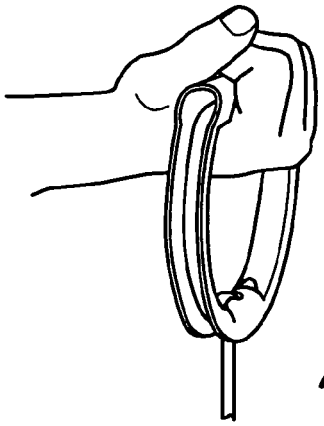

In the gripping of the handle, there are generally three ways one can use the handle hereof. These are: Channel Grip, Vertical Grip, and Stirrup Grip. Each position can be used with most of the exercises as is generally described herein. In the vertical grip, the handle is positioned so that the tubing exits from the bottom and the top of the handle as shown for example in FIG. 17A. This allows for positioning of the wrist in multiple positions and angles. In the channel grip as shown for example in FIG. 17B, the tubing is disposed in the channel around the handle, and with this the user can take advantage of the increased resistance and stabilizing properties of the handle for upper and lower exercise positions. A further alternative grip is the Stirrup grip, which was described relative to FIG. 15. This is the traditional Stirrup Grip used in other exercise modalities.

Figure 18A:
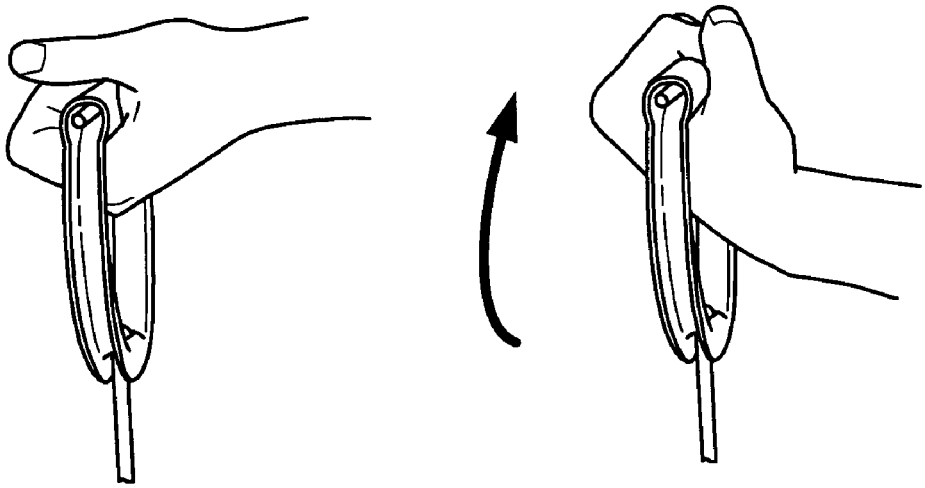
FIG. 18, which includes sub-part FIGS. 18A and 18B, provides a set of exercises performable herewith.

In this vein, a first set of exercises using the stirrup grip can be described. In FIG. 18A, a Flexion exercise for the wrist is shown. First, the handle hereof is setup in the stirrup grip position described above. Then, the user holds the handle with palm facing upwards and the handle and tubing projecting back from the rear of the user's hand. The tubing should be secured from a position below the handle (e.g., stepped on). The user allows his/her wrist to bend down and back into full extension. This is the starting position. The tubing should have some tension in it at this position. The wrist is then curled up into full flexion, keeping a loose grip on the handle. The user then relaxes and repeats for the recommended number of repetitions and sets. Note: The grip position is the traditional grip used for this exercise and keeps the rotational forces distributed equally in the hand.

Figure 18B:
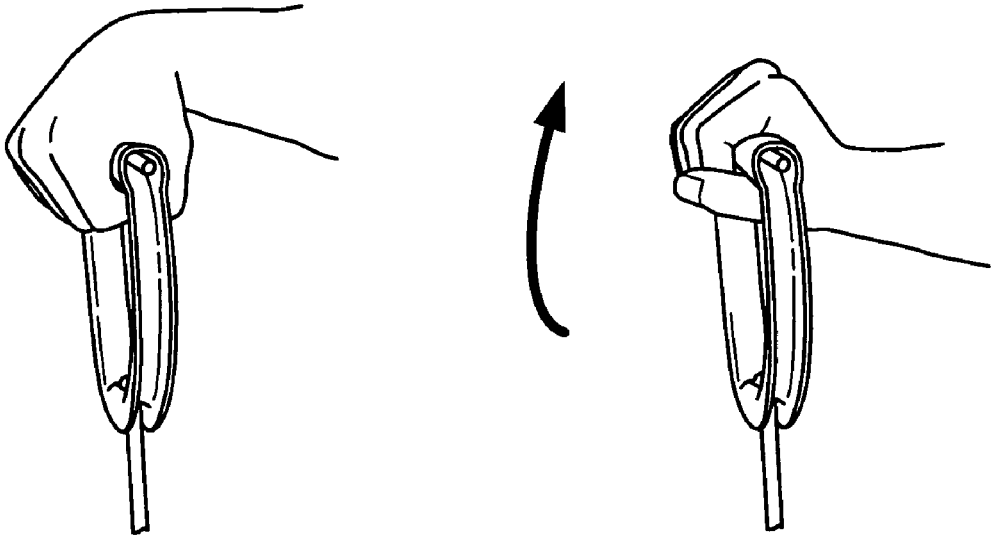

In FIG. 18*b*, an Extension exercise for the wrist is depicted. First, the handle is setup in stirrup grip position as above. Then, the user holds the handle with palm facing downwards and the handle and tubing projecting down from the palm side of the hand. The tubing should be secured from a position below the handle (e.g. stepped on). The wrist may then be allowed to bend down into full flexion. This is the starting position. The tubing should have some tension in it at this position. The wrist is then curled up into full extension, keeping a loose grip on the handle. The user then relaxes and repeats for the recommended number of repetitions and sets. Note: The grip position is the traditional grip used for this exercise and keeps the rotational forces distributed equally in the hand.

However, the handle hereof was designed for more than a traditional stirrup grip, indeed, was designed for a more effective method of targeting specific muscles using resistance tubing. The result, is the present 3-way Fitness and Therapy Handle which makes use of a Multi-Angular Rotating Vector as described herein and is the latest development in exercise and rehabilitation technology.

Unique exercises that can be performed with the described handle include:

Wrist:
- Radial deviation
- Ulnar deviation

Elbow:
- Hammer curl
- Supination
- Pronation
- Biceps curl with supination
- Triceps extension (wrist in neutral)

Shoulder:
- Internal rotation (arm straight)
- External rotation (arm straight)
- Flexion
- Extension
- Abduction
- Adduction
- Horizontal adduction
- Horizontal abduction
- Chest press
- Lat Row
- Internal rotation (extended moment arm)
- External rotation (extended moment arm)
- Internal rotation (with pronation)
- External rotation (with supination)
- PNF patterns Drawings demonstrating these exercises are included herein as shown and described hereafter.

Figure 19A:
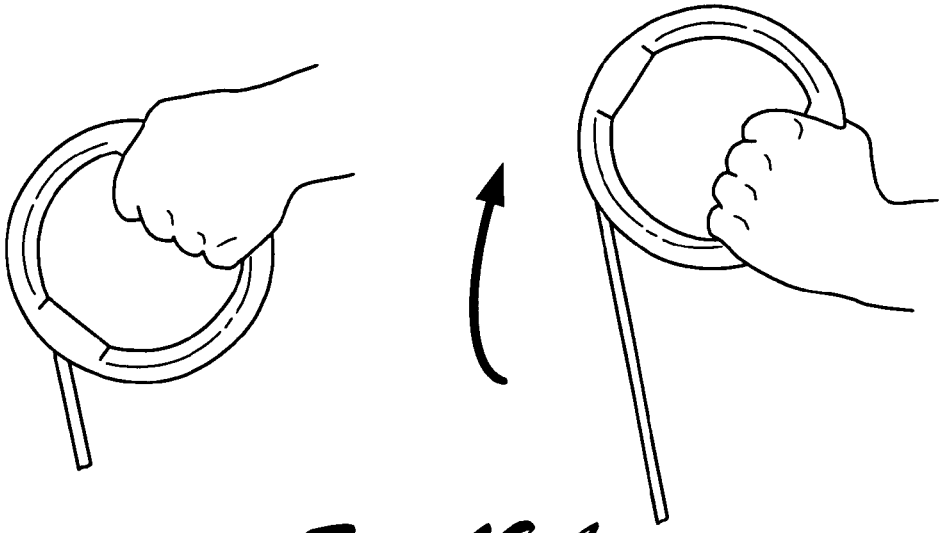
FIG. 19, which includes sub-part FIGS. 19A and 19B, provides a set of exercises performable herewith.

Two further wrist exercises herefor include the radial and ulnar deviation introduced above. As shown in FIG. 19A, the Radial Deviation exercise involves the set up of the handle hereof in the channel grip position. The user then holds the handle with the thumb side of his/her hand facing up and the tubing projecting down from the channel side of the handle. The tubing should be secured from a position below the handle (e.g. stepped on). The user then allows his/her wrist to bend down at the pinky side into full ulnar deviation. This is the starting point. The tubing should have some tension in it at this position. The user then bends his/her wrist up into full radial deviation. Next is a relaxation and then a repeat for the recommended number of repetitions and sets. Note: The unique channel feature of the handle hereof allows for the moment arm to be increased, thereby increasing the effective tension and the effective range of tension. Also, the universal tube adapter (i.e., the ability to use resistance tubes of any practical diameter) allows for infinite levels of resistance.

Figure 19B:
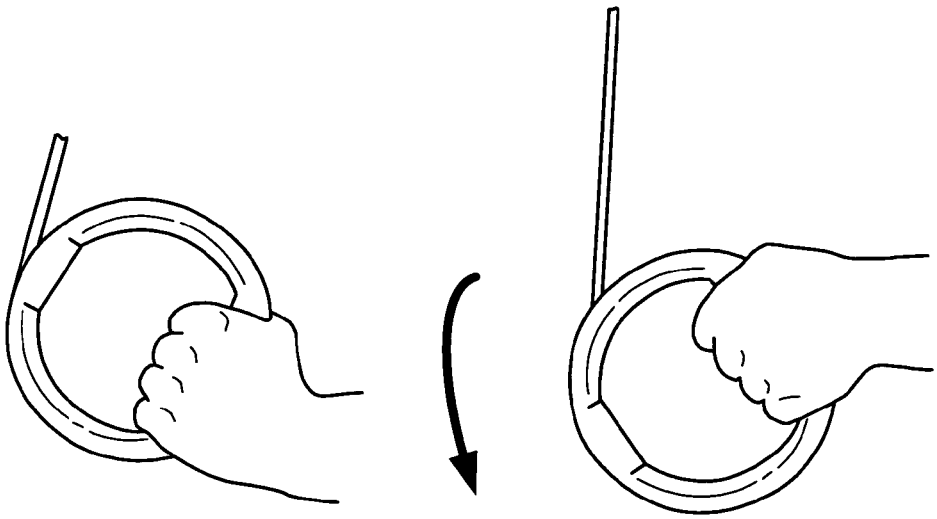

In FIG. 19B, an Ulnar Deviation wrist exercise is shown with the handle set up in the channel grip position. Here the user holds the handle with the thumb side of his/her hand facing up and the tubing projecting upwards from the channel side of the handle. The tubing should be secured from a position above the handle (e.g., held with the user's free hand). The user then allows his/her wrist to bend up at the thumb side into full radial deviation. This is the starting point. The tubing should have some tension in it at this position. The user then bends his/her wrist down into full ulnar deviation. Then, relaxes and repeats for the recommended number of repetitions and sets. Note: The unique channel feature of the handle hereof allows for the moment arm to be increased, thereby increasing the effective tension and the effective range of tension.

Figure 20A:
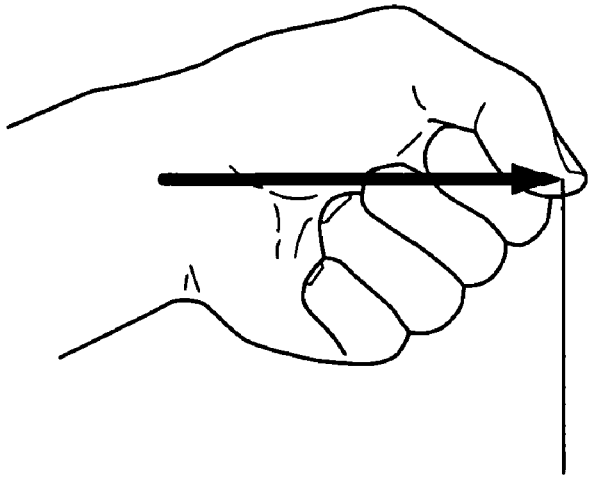
FIG. 20, which includes sub-part FIGS. 20A and 20B, provides a depiction of alternative exercise values.
Figure 20B:
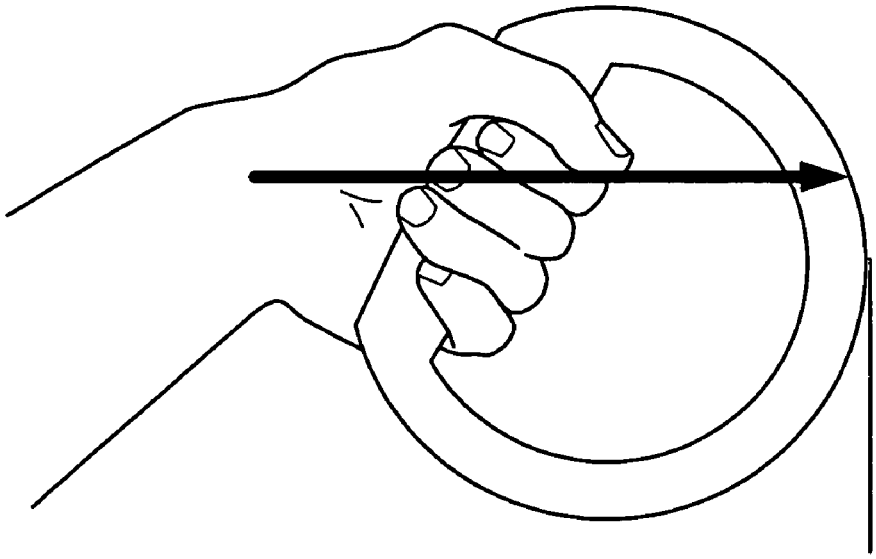

This is shown more particularly in FIG. 20 where the distance from the center of rotation of the wrist to the location of the torque force is shown by the arrow. In FIG. 20A, a shorter arrow is presented where a load might be draped off the meeting point of the thumb and forefinger as opposed to the arrow in FIG. 20B which shows the radius of the moment arm when a channel handle hereof is used. In other words, if the same downward resistance force is applied to the hands of respective FIGS. 20A and 20B, the torque is greater in the implementation of FIG. 20B due to the longer radius of the moment arm (Torque=radius×force).

Figure 21A:
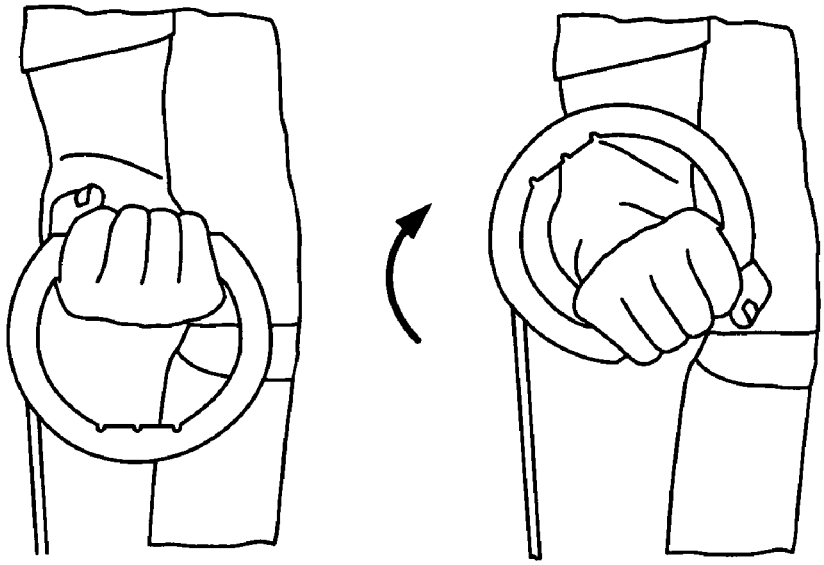
FIG. 21, which includes sub-part FIGS. 21A and 21B, provides a set of exercises performable herewith.

Further channel grip exercises include the Elbow Exercises such as supination and pronation. In FIG. 21A, a Supination exercise is shown where the handle is disposed in the channel grip position. The user's upper arm should be held to the side with the elbow bent to 90°. The user then holds the handle with the palm facing down and the tubing projecting down from the inside/thumb side of the handle. The tubing is secured from a position below the handle (e.g. stepped on). The tubing should have some tension in it at this position. Keeping a firm grip on the handle, the user then rolls their forearm and turns their palm up performing supination. The user may then relax and repeat for the recommended number of repetitions and sets.

Figure 21B:
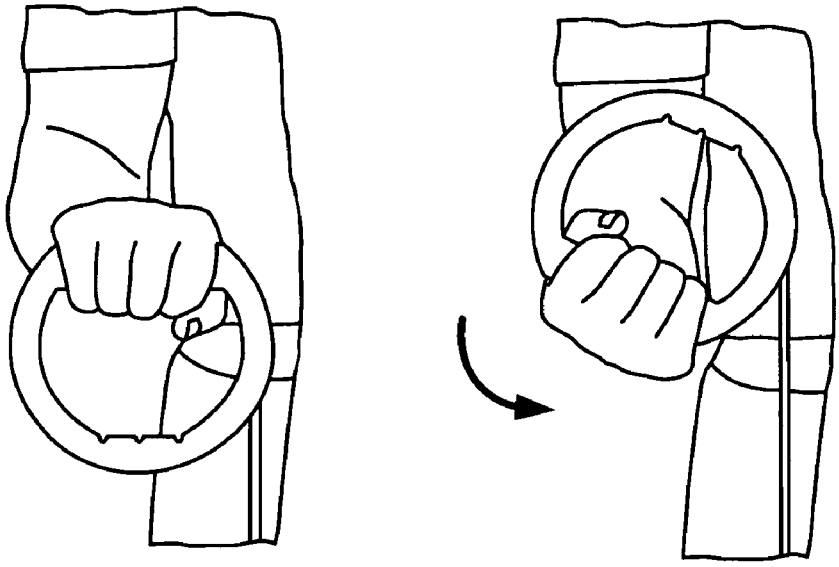

In FIG. 21B, a pronation elbow exercise is shown also with the handle disposed in the channel grip position. The user's upper arm is held to the side with the elbow bent to 90°. The user then holds the handle with the palm facing up and the tubing projecting down from the outside/thumb side of the handle. The tubing is secured from a position below the handle (e.g. stepped on). The tubing should have some tension in it at this position. Keeping a firm grip on the handle the user then rolls their forearm and turn their palm down performing pronation. The user then relaxes and repeats for the recommended number of repetitions and sets.

Figure 22A:
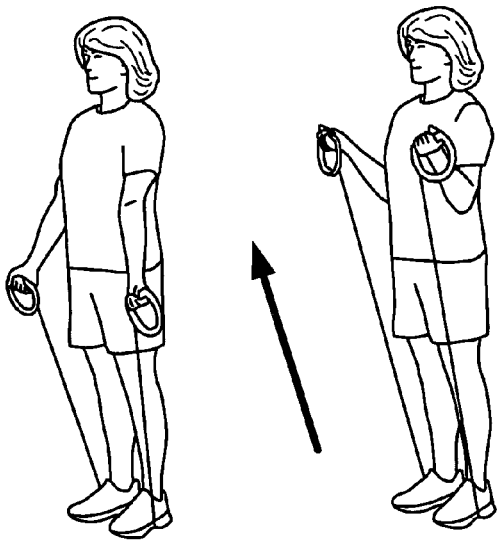
FIG. 22, which includes sub-part FIGS. 22A, 22B, 22C, 22D, 22E and 22F, provides a set of exercises performable herewith.

A large variety of Arm Exercises are available. In a first set, six varieties of curl exercises are shown in the drawings. The basic Biceps Curl exercise is shown in FIG. 22A, here with the handles set up in channel grip position. The handles should be held with palms facing up. The tubing may then project down from the inside channel (pinky side) of each hand (although in an alternative biceps curl exercise, the tubing may be made to project down from the outside channel (the thumb side) of each hand). The tubing is secured from a position below the handle (i.e. may be stepped on by the user). The user keeps the hands palms up with wrists held in a neutral to slightly bent back position. The upper arms are held at the sides with the elbows straight. This is the starting position. The tubing should have some tension in it at this position. The arms are then curled up into full flexion, keeping a loose grip on the handle (the handle(s) may be allowed to rotate slightly in the grip so that the tubing stays in line with the channel(s)). The user may then relax and repeat for a recommended number of repetitions and sets.

Figure 22B:
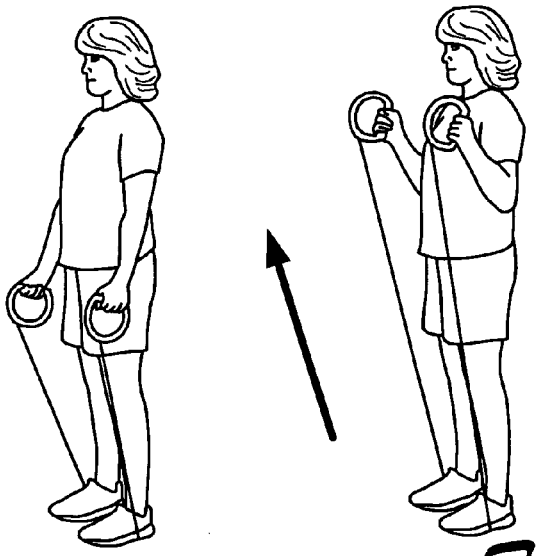

A second alternative is the basic Hammer Curl exercise shown in FIG. 22B, Here, the user stands with one or both feet on the tube, holds the handles positioning the hands at the sides. The elbows are bent and then the arms curled up in front of the body to shoulder height. The wrists are kept firm and elbows kept close to the sides. The user may then return to starting position and repeat. For this Hammer Curl, the handles may be in some implementations be set up in the channel grip position. The handles may then be held with the hands held in neutral—with the thumb-side of the hands pointing up. The tubing projects down from the outside edges of the channels of each hand. The tubing is secured from a position below the handle, the hands kept in a neutral position with wrists held secure. The user then holds the upper arms at his/her sides with the elbows straight. This is the starting position. The tubing should have some tension in it at this position. The arms are then curled up into full flexion, keeping a tight grip on the handle. The next step is a relaxation and then a repeat for the recommended number of repetitions and sets.

Figure 22C:
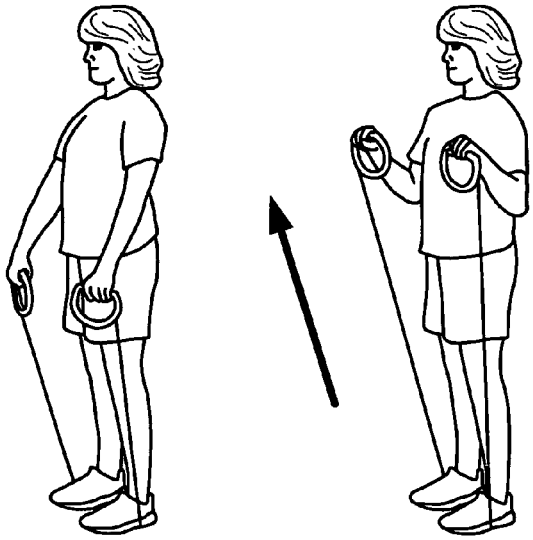

A third exemplar curl is the Reverse Curl shown in FIG. 22C. The handles may be set up in channel grip position. The handles may be held with palms facing down and the handles pointing down towards the floor. The tubing projects down from the outside channels (pinky side) of each hand (although in an alternative reverse curl exercise, the tubing may be made to project down from the inside channel (the thumb side) of each hand). The tubing is secured from a position below the handle (e.g. stepped on). The hands should be kept palms down with wrists held in a neutral position. The upper arms should be held at the sides with the elbows straight. This is the starting position. The tubing should have some tension in it at this position. The arms may then be curled up into full flexion, keeping a loose grip on the handle (optionally allowing the handle to rotate slightly in the grip so that the tubing stays in line with the channel(s)). The user may then relax and repeat for the recommended number of repetitions and sets.

Figure 22D:
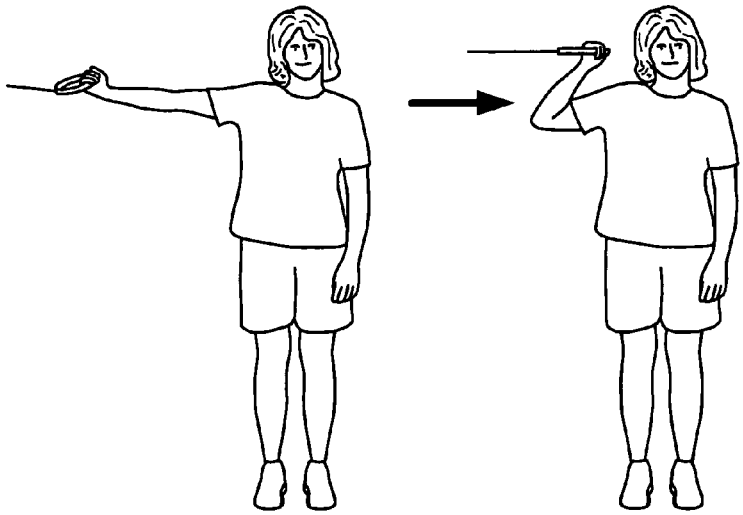

In a Concentration Curl (side) as shown in FIG. 22D, the handle(s) may be set up in the channel grip position. The handle may then be held with the arm extended out to the side of the body, palm facing up and the handle pointing towards the anchor (e.g., door) on the side of the body where it is secured. The tubing projects out from the inside channel (pinky side) of the hand (although in an alternative concentration curl exercise, the tubing may be made to project from the outside channel (the thumb side) of each hand). The hand should be kept palm up with wrist held in a neutral to slightly bent back position. The upper arm is held straight out to the side. This is the starting position. The tubing should have some tension in it at this position. The arm is curled up into full flexion, keeping a loose grip on the handle (optionally allowing the handle to rotate slightly in the grip so the tubing stays in line with the channel). The user may then relax and repeat on each side for the recommended number of repetitions and sets.

Figure 22E:
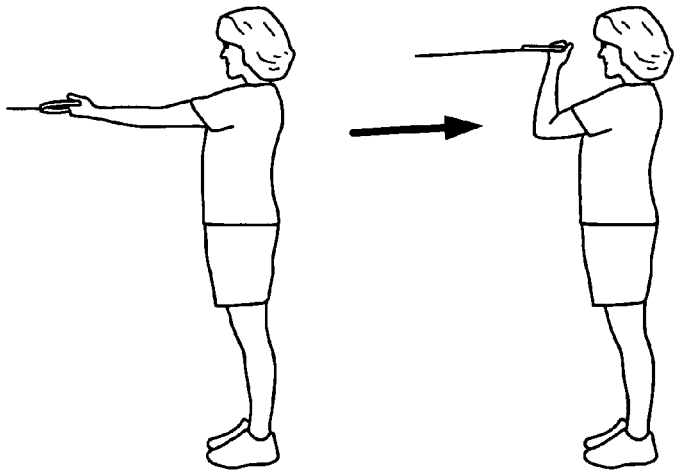

In a Preacher Curl as shown in FIG. 22E, the handle may be set up in the channel grip position. The handle may be held with the arm extended in front of the body, palm facing up and the handle pointing forward towards the anchor (e.g., door) in front of the user (where it is secured). The tubing projects out from the inside channel (pinky side) of the hand (although in an alternative preacher curl exercise, the tubing may be made to project from the outside channel (the thumb side) of each hand). The hand is kept palm up with wrist held in a neutral to slightly bent back position. The upper arm is held straight out in front of the user with the elbow pointing to the front. This is the starting position. The tubing should have some tension in it at this position. The arm is curled up into full flexion, keeping a loose grip on the handle (allowing the handle to rotate slightly in the grip so the tubing stays in line with the channel). The user may then relax and repeat on each side for the recommended number of repetitions and sets.

Figure 22F:
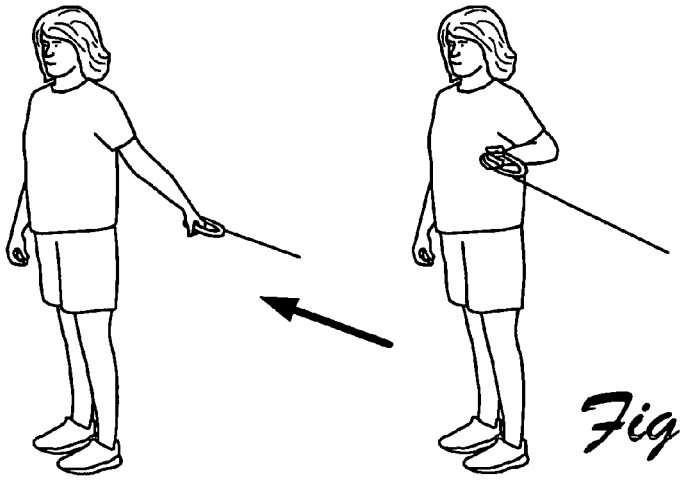

The sixth shown curl is the Incline Curl exercise shown in FIG. 22F. Here the handle may be set up in the channel grip position. The handle may be held with the arm extended behind the body, palm facing forwards and the handle pointing down and back towards the floor. The tubing projects down from the inside channel (pinky side) of the hand (although in an alternative incline curl exercise, the tubing may be made to project from the outside channel (the thumb side)

of each hand). The tubing is secured from a position behind the arm (e.g. secured in a door). The hand may be kept palm down with wrist held in a neutral to slightly bent back position. The upper arm is held at the side with the elbow pointing backwards. This is the starting position. The tubing should have some tension in it at this position. The arm is then curled up into full flexion, keeping a loose grip on the handle (allow the handle to rotate slightly in the grip so the tubing stays in line with the channel). The user then relaxes and repeats on each side for the recommended number of repetitions and sets.

Figure 23A:
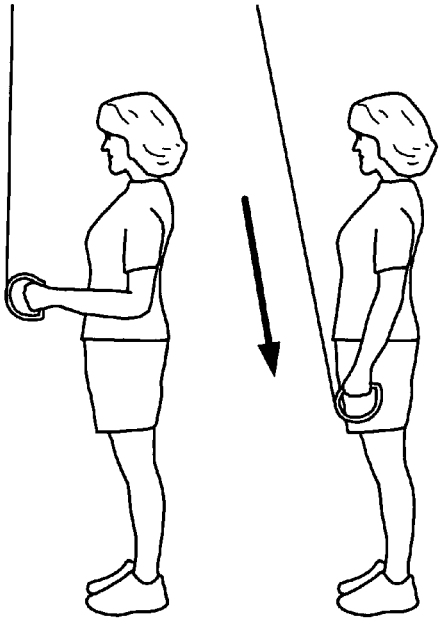
FIG. 23, which includes sub-part FIGS. 23A, 23B, 23C and 23D, provides a set of exercises performable herewith.

Four triceps exercises are shown. In the Triceps Pressdown exercise as shown in FIG. 23A, the handles may be set up in channel grip position. The handles may be held with the hands held in neutral—with the thumb-side of the hand pointing up. The tubing projects up from the outside edges of the channels of each hand. The tubing is secured from a position above the handle (e.g. secured in a door). The upper arms are held at the sides with the elbows bent. This is the starting position. The tubing should have some tension in it at this position. The arms are pressed down into full extension, keeping the wrists stable while maintaining a firm grip on the handles. The user may then relax and repeat for the recommended number of repetitions and sets.

Figure 23B:
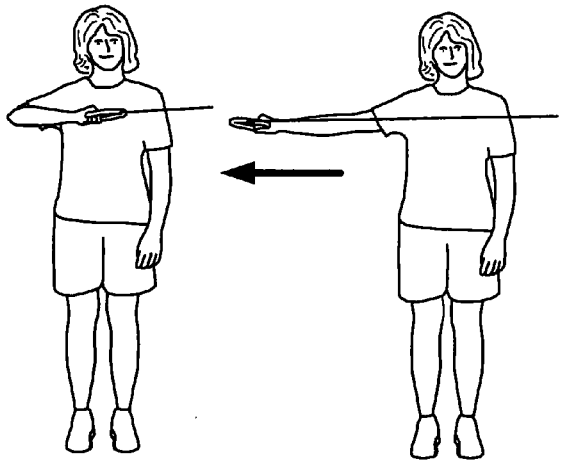

In the Triceps Extension exercise as shown in FIG. 23B, the handles may be set up in channel grip position. The handles are held with the hands held in neutral—with the thumb-side of the hand pointing up. The tubing projects back from the outside/pinky edges of the channels of each hand. The tubing is secured from a position behind the body (e.g. secured in a door). The arms are held with the elbows pointed in front of the body and the elbows bent. This is the starting position. The tubing should have some tension in it at this position. The arms are pressed forward into full extension, keeping the wrists stable while maintaining a firm grip on the handles. The user relaxes and repeats for the recommended number of repetitions and sets.

Figure 23C:
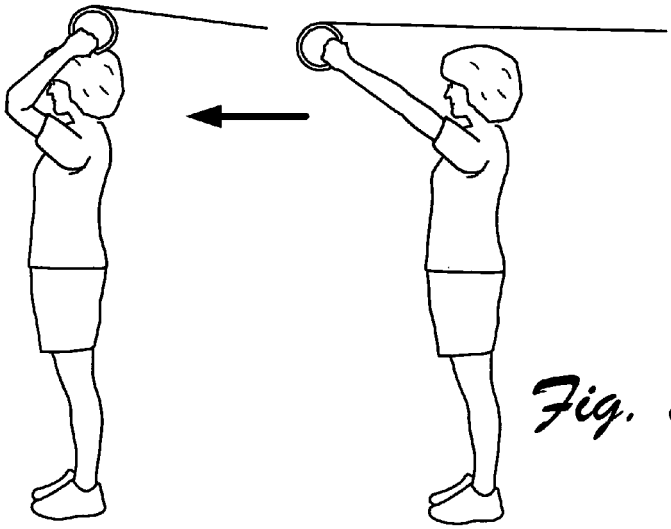

In the Side Triceps Extension shown in FIG. 23C, the handle is set up in channel grip position. The elbow is pointed to the side with the arm bent, and the handle held with the palm of the hand facing down (the thumb side of the hand should be closest to the body). The tubing projects out from the outside/pinky edge of the channel. The tubing is anchored or held with the opposite hand at chest level/height. This is the starting position. The tubing should have some tension in it at this position. The arm is pressed to the side into full extension, keeping the wrist stable while maintaining a firm grip on the handle. The user may then relax and repeat for the recommended number of repetitions and sets. It may be noted in an implementation of the Triceps Side Extension that one handle may be held chest high with that arm substantially horizontal to the floor while the tube may be grasped with the other hand as shown in the Fig. The arm may then be extended until it is straight, returned to the starting position with an increase or reduction of the resistance achievable by shortening or lengthening the tube length.

Figure 23D:
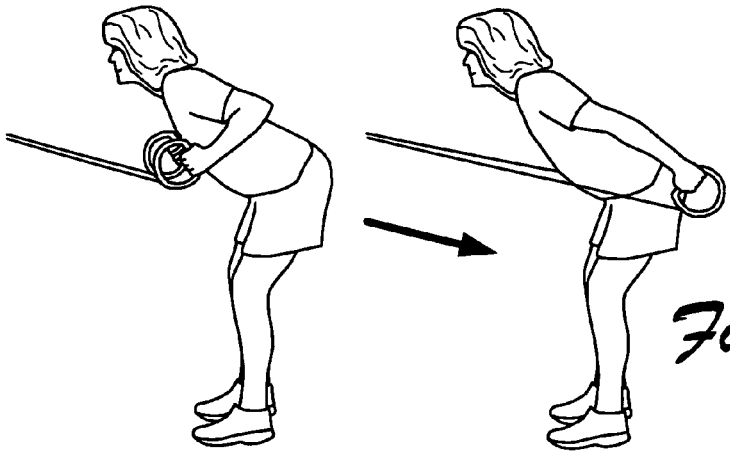

In the Triceps Kickback exercise shown in FIG. 23D, the handles may be set up in channel grip position. The user bends the torso slightly with the knees bent and feet shoulder width apart. The handles are held with the hands held in neutral/with the thumb-sides of the hands pointing up. The tubing projects up from the outside/pinky edges of the channels of each hand. The tubing is secured from a position in front of the body (e.g. secured in a door). The upper arms are held close to the body with elbows pointed behind the user and elbows bent. This is the starting position. The tubing should have some tension in it at this position. The arms are pressed back into full extension, keeping the wrists stable while maintaining a firm grip on the handles. The user then relaxes and repeats for the recommended number of repetitions and sets.

A variety of Upper Body and Shoulder Exercises are available including for initial examples, the shoulder press, chest press, lateral raise and lat pulldown.

Figure 24A:
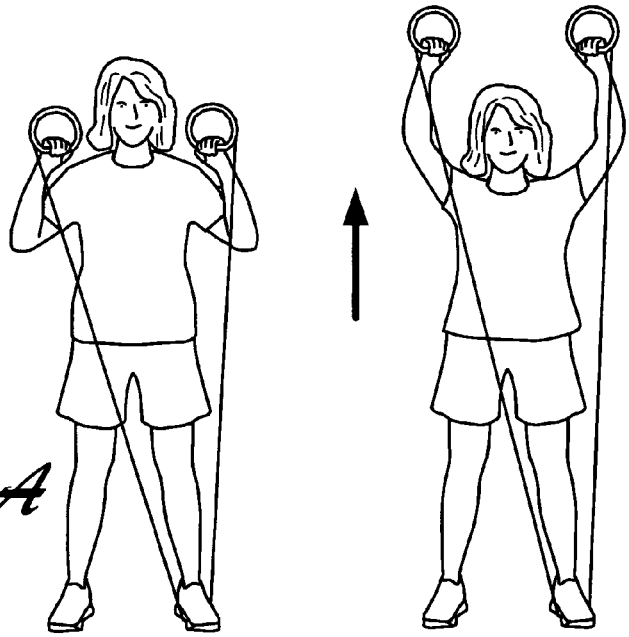
FIG. 24, which includes sub-part FIGS. 24A and 24B, provides a set of exercises performable herewith.

For the shoulder press shown in FIG. 24A, the user stands on the tube with one or both feet, holds the handles shoulder high palms facing out or forward, and presses the handles upward above the head until the arms are straight, returns to shoulder high position, and repeats as desired. For these Shoulder Presses using the handles hereof, these handles may be set up in channel grip position. The tubing may project down from the channel at the pinky side of the Handles (although in an alternative shoulder press exercise, the tubing may be made to project down from the inside channel (the thumb side) of each hand). The tubing should be secured from a position below the handle and may have some variable tension in it. In pressing the arms overhead, a tight grip should be kept on the handles with the wrists kept in neutral (i.e., not allowing them to bend). Note: The unique channel feature of the handle hereof increases the moment arm and keeps the tubing at an improved vector thereby increasing the effective range of motion and tension during this exercise.

Figure 24B:
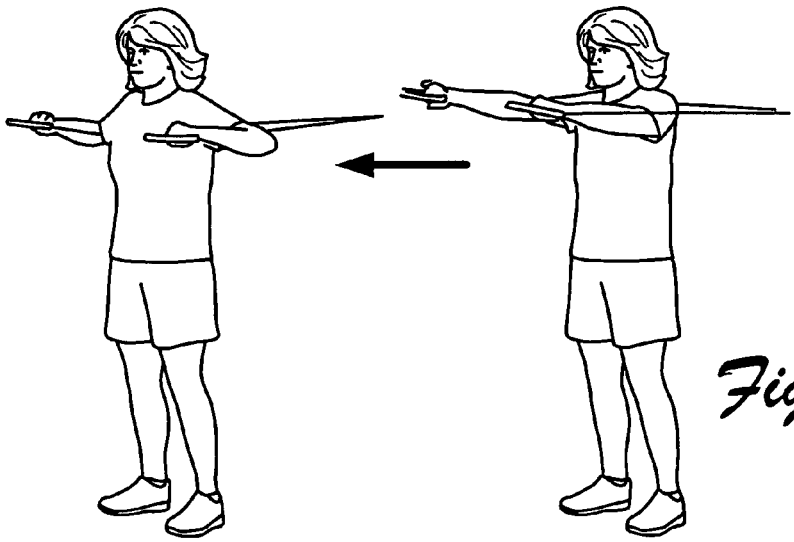

For the chest press as shown in FIG. 24B, a door attachment may be used and attached to the middle of the tube and secured to the hinge side of the door about or just above shoulder height. The user may then face away from the door with hands chest high and then press with both hands forward, keeping hands chest high. The user may then return to the starting position and repeat. With such a Chest Press, the handles may be set up in channel grip position. The handles are held with the arms held at shoulder height, elbows out to the sides (humerus abducted to ~80°) palms facing down. The tubing should project back from the channel at the pinky side of the handles (although in an alternative chest press exercise, the tubing may be made to project from the inside channel (the thumb side) of each hand). The tubing should be secured from a position behind the user (e.g., secured in a door with a door attachment device). The tubing should have some tension in it at this position. The user then presses his/her arms to the front being sure to keep a tight grip on the handles and keep the wrists in neutral (not allowing them to bend). Note here as well: The unique channel feature of the handle hereof increases the moment arm and keeps the tubing at an improved vector thereby increasing the effective range of motion and tension during this exercise.

Figure 25A:
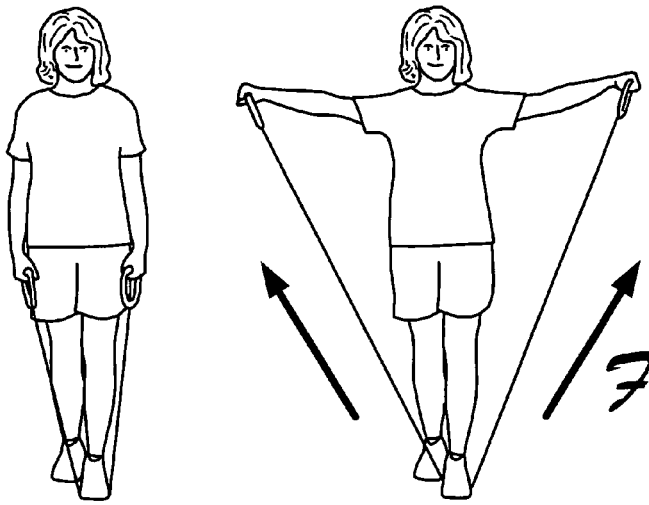
FIG. 25, which includes sub-part FIGS. 25A, 25B and 25C, provides a set of exercises performable herewith.

For the Lateral Raise exercise as shown in FIG. 25A, the user starts with arms at the sides palms facing the body with the stirrup grip or facing front with the channel grip (see unilateral abduction and empty can descriptions below). The user then raises or lifts both arms until handles are shoulder high with palms down. The user may then lower the handles to the original position, and may repeat. The user can also raise the handles to the front for a front raise (described also below). The Lateral Raise may also be known as an Abduction exercise. In the stirrup grip, the tubing projects down from the center of the handle. The tubing may be secured from a position below the handle (e.g. stepped on).

Figure 25B:
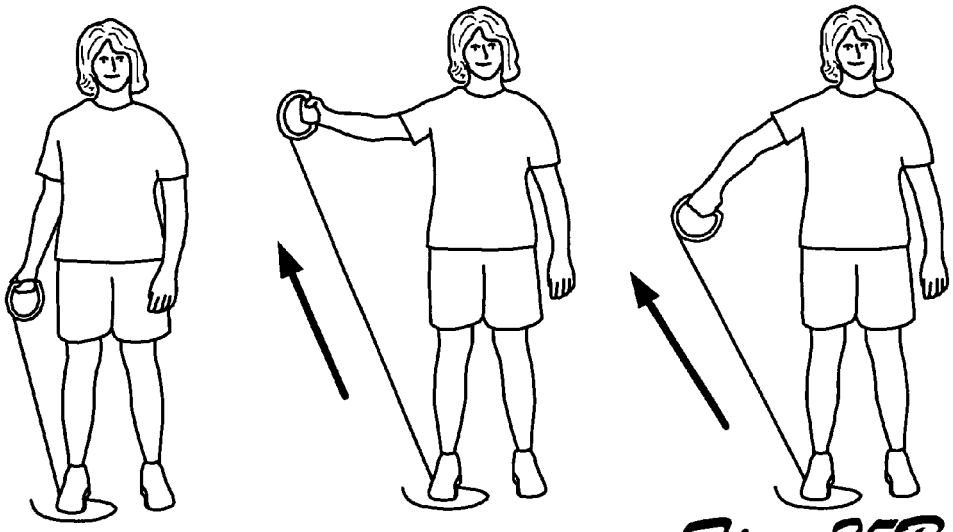

A second alternative Abduction exercise is shown in FIG. 25B. This is a unilateral exercise which also shows use of the handle hereof set up in the channel grip position. The handle is held with the palm of the hand facing front and the tubing projecting down from the channel at the thumb side of the handle hereof. The arm should start at the side. This is the starting point. The tubing should be secured from a position below the handle (e.g. stepped on). The tubing should have some tension in it at this position. The arm is raised to the side (thumb up) to shoulder level. The arm is then lowered to the side and this cycle may then be repeated for the recommended number of repetitions and sets. Note: The unique channel feature of the handle hereof allows for the moment arm to be increased, thereby increasing the effective tension and the effective range of motion. In an alternative abduction exercise example like the unilateral exercise just described, called the Empty Can exercise see the third part of FIG. 25B, the handle is here also set up in the channel grip position, held with the palm of the hand facing back and the tubing projecting down from the channel at the pinky side of the handle. The arm should be at the side. This is the starting point. The tubing should be secured from a position below the handle. The tubing should have some tension in it at this position. The arm is raised to the side, thumb down, to shoulder level. The motion should be approximately 45° from the coronal plane. The arm is lowered and repeated for the recommended number of repetitions and sets. Note: The unique channel feature of the handle hereof allows for the moment arm to be increased, thereby increasing the effective tension and the effective range of motion.

Figure 25C:
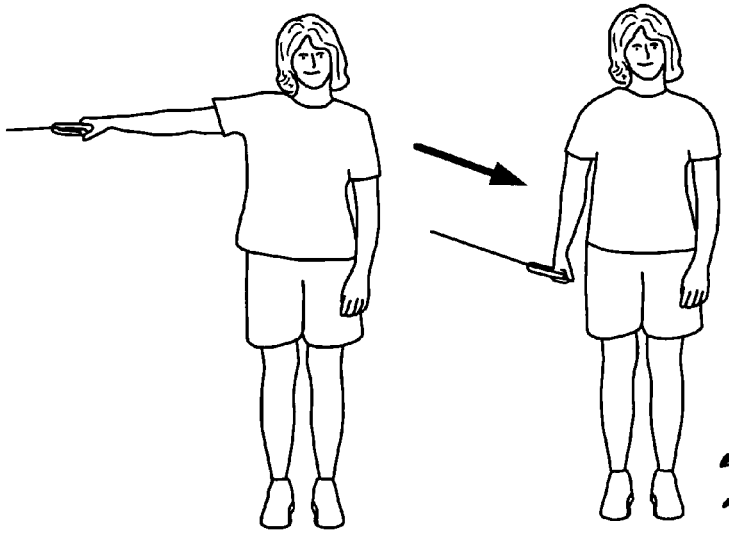

In an Adduction exercise as shown in FIG. 25C, the handle hereof may be set up in the either the stirrup or the channel grip position. The user holds the handle with the arm held out to the side and the hand facing the floor. The tubing projects either out from the center of the handle in the stirrup grip or from one or the other side of the handle in the channel grip position. The tubing should be secured from a position out to the side of the user (e.g., secured in a door with an attachment device). The tubing should have some tension in it at this position. This is the starting point. The user pulls the arm to the side keeping his/her elbow and wrist straight, also being sure to keep a slightly "loose" grip on the handle to allow it to swivel slightly in the hand as this exercise is performed. The arm is allowed to return to the starting position and the exercise is repeated for the recommended number of repetitions and sets.

Figure 26A:
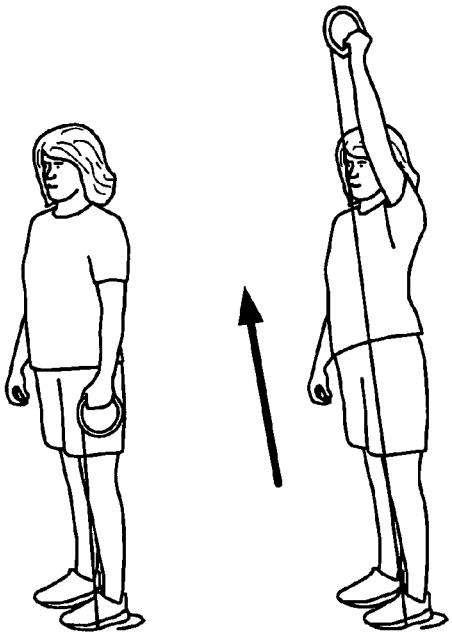
FIG. 26, which includes sub-part FIGS. 26A, 26B and 26C, provides a set of exercises performable herewith.
Figure 26B:
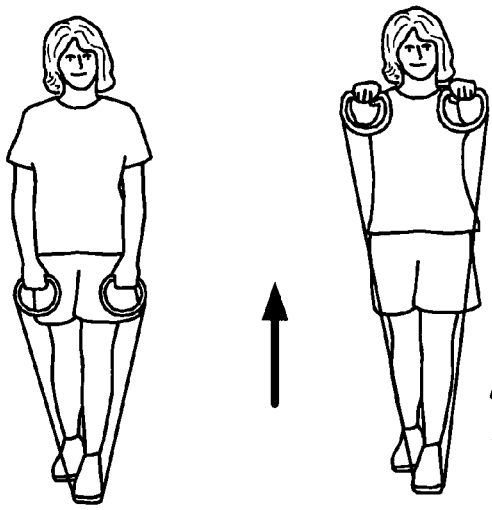

Similar arm raise exercises are shown in FIG. 26, these exercises also known as Flexion exercises. In FIG. 26A, the handles may be set up in a stirrup grip or in a channel grip position. The user then holds the handles with the arms in front of the thighs and the palms facing the body. The tubing should project down from the handles either at the center via the stirrup grip or from either side (pinky or thumb) if in a channel grip. The tubing should be secured from a position below the handles (e.g. stepped on). The tubing should have some tension in it at this position. This is the starting point. The user then raises the arm or arms to the front to 90° of flexion (shoulder level) and then lowers the arms and repeats for the recommended number of repetitions and sets. In FIG. 26B, a unilateral Flexion exercise is shown with a front channel grip position (not unlike the hammer curl position). The user holds the handle with the arm at the side and the thumb forward. The tubing projects down from the channel at the thumb side of the handle. The tubing is secured from a position below the handle (e.g. stepped on). The arm is then raises to the front and may be raised to 90° of flexion (shoulder level) or higher to 180° of flexion as shown in the FIG. 26A. The user then lowers the arm and repeats for the recommended number of repetitions and sets.

Figure 26C:
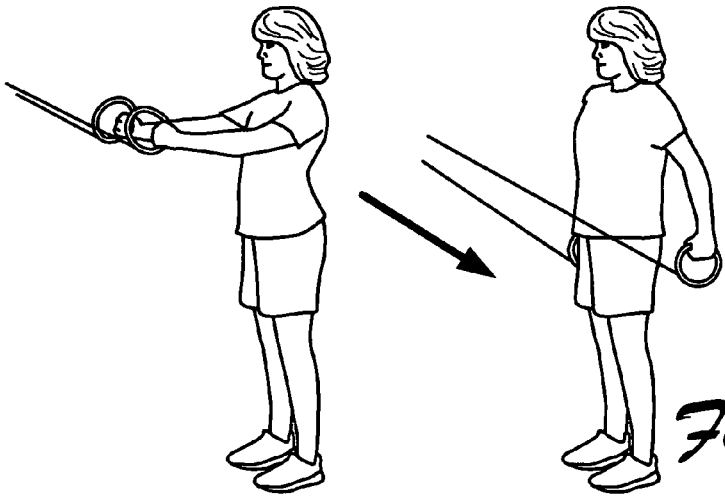

In FIG. 26C, an Extension exercise is shown with the handles set up in a channel grip position. The user holds the handles with a "thumbs up" position and the tubing projecting out from the channels at the pinky side of the handles. The arms should be held in front of the body with elbows straight. This is the starting point. The tubing should be secured from a position in front of the user at a level between waist and shoulder height (e.g., secured over a door with the attachment device). The tubing should have some tension in it at this position. The user then pulls the arms straight back while squeezing the shoulder blades back being sure to keep the wrists in neutral (not allowing them to bend). The user then returns to the starting position and repeats for the recommended number of repetitions and sets. Note: The unique channel feature of the handle hereof increases the moment arm and keeps the tubing at an improved vector thereby increasing the work across the wrists and increasing the effective range of motion and tension during this exercise. Unilateral Extension exercises may also be performed.

Figure 27A:
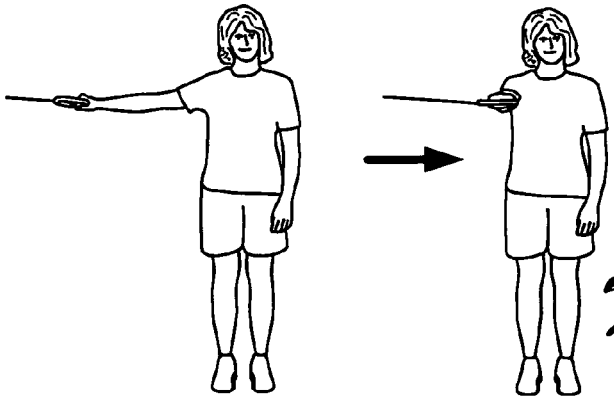
FIG. 27, which includes sub-part FIGS. 27A and 27B, provides a set of exercises performable herewith.

A Horizontal Abduction is shown in FIG. 27A with the handle set up in the channel grip position. The arm is held in 90° flexion with the handle held palm down with the tubing projecting to the side (contralateral) from the channel at the pinky side of the handle. This is the starting point. The tubing should be secured from a position on the opposite side of the body at about shoulder height and approximately perpendicular to the arm (e.g., secured in a door with the attachment device). The tubing should have some tension in it at this position. The arm is then horizontally abducted to the side. The user should be sure to keep the elbow straight and the arm level. The end point should be with humerus at 90° abduction in the transverse plane. The arm should be allowed to return to starting position and repeat for the recommended number of repetitions and sets. Note: The unique channel feature of the handle allows for the moment arm to be increased, thereby increasing the effective tension and the effective range of motion.

Figure 27B:
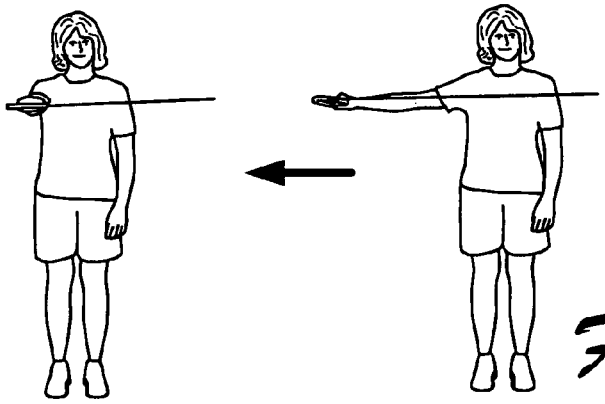

A Horizontal Adduction exercise is shown in FIG. 27B, with the handle set up in the channel grip position. The arm may be held in 90° abduction with the handle held palm down with the tubing projecting to the side (ipsilateral) from the channel at the thumb side of the handle. This is the starting point. The tubing should be secured from a position on the same side of the body at about shoulder height and approximately parallel to the arm (i.e. secure it in a door with the attachment device). The tubing should have some tension in it at this position. The user then horizontally adducts the arm to the front being sure to keep the elbow straight and the arm level. The end point should be with humerus at 90° flexion in the transverse plane. The arm should be allowed to return to starting position and repeat for the recommended number of repetitions and sets. Note: The unique channel feature of the handle hereof allows for the moment arm to be increased, thereby increasing the effective tension and the effective range of motion.

Figure 28A:
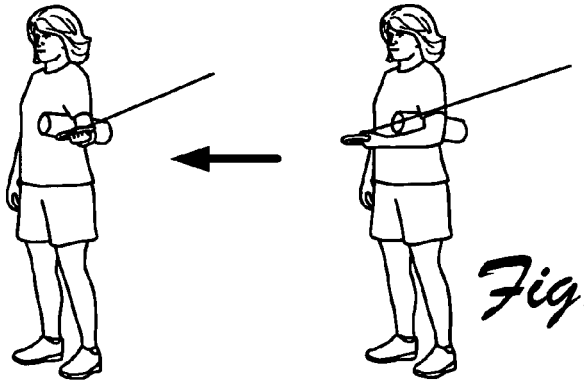
FIG. 28, which includes sub-part FIGS. 28A and 28B, provides a set of exercises performable herewith.

Horizontal exercises for forearm movement only are next shown with internal and external rotations. For an Internal Rotation exercise as shown in FIG. 28A, the handle may be set up in the channel grip position. The upper arm is held at the side (in some implementations, as shown, with a roll between the body and humerus) and the elbow bent to 90°. The user allows the arm to rotate to the side. The handle is held palm up and the tubing projecting across the body from the channel at the pinky side of the handle (note a palm down alternative may also be performed). This is the starting point. The tubing should be secured from a position to the side, and slightly above elbow level (e.g. secured in a door with the attachment device). The tubing should have some tension in it at this position. The arm is rotated inwards, across the body (internally rotated) being sure to keep the humerus at the side and the elbow bent to 90°. The arm is allowed to return to starting position and repeated for the recommended number of repetitions and sets. Note: The unique channel feature of the handle allows for the moment arm to be increased, thereby increasing the effective tension and the effective range of motion.

Figure 28B:
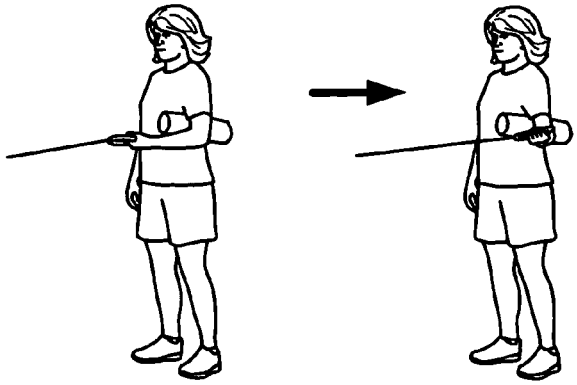

For an External Rotation exercise as shown in FIG. 28B, the handle may also be set up in channel grip position. The upper arm may be held at the side (in some implementations with a roll between the body and humerus) and the elbow bent to 90°. The arm may then be allowed to rotate to the front. The handle may then be held palm up and the tubing projecting across the body from the channel at the thumb side of the handle (note a palm down alternative may also be performed). This is the starting point. The tubing should be secured from a position to the side, and slightly below elbow level (i.e. secure it in a door with the attachment device). The tubing should have some tension in it at this position. The arm may then be rotated out to the side (externally rotated) being sure to keep the humerus at the side and the elbow bent to 90°. The arm may then be allowed to return to starting position and repeat for the recommended number of repetitions and sets. Note: The unique channel feature of the handle allows for the moment arm to be increased, thereby increasing the effective tension and the effective range of motion.

Figure 29A:
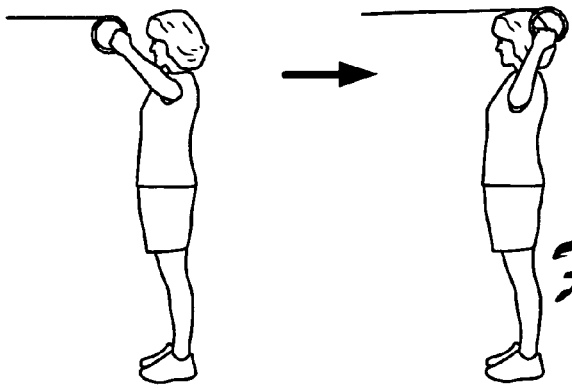
FIG. 29, which includes sub-part FIGS. 29A and 29B, provides a set of exercises performable herewith.

In an alternative External Rotation exercise (non-horizontal) as shown in FIG. 29A, the handle is here also set up in the channel grip position. The humerus is held in abduction (to 90°) and the elbow bent to 90°. The arm is allowed to rotate to the front. The handle is held thumb side up and the tubing projecting forward from the channel at the thumb side of the handle. This is the starting point. The tubing should be secured from a position in front of the handle at about head height (e.g. secured in a door with the attachment device). The tubing should have some tension in it at this position. The arm is rotated back (externally rotated) being sure to keep the humerus in 90° abduction and the elbow bent to 90°. The arm is allowed to return to the starting position and the cycle repeated for the recommended number of repetitions and sets. Note: The unique channel feature of the handle hereof allows for the moment arm to be increased, thereby increasing the effective tension and the effective range of motion.

Figure 29B:
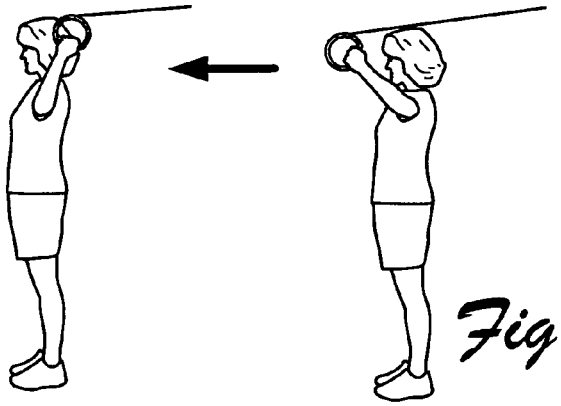

In a similar, but Internal Rotation exercise (also non-horizontal) as shown in FIG. 29B, the handle can again be set up in channel grip position. The humerus should be held in abduction (to 90°) and the elbow bent to 90°. The arm is allowed to rotate to the rear. The handle should be held thumb side up and the tubing projecting backward from the channel at the pinky side of the handle. This is the starting point. The tubing should be secured from a position behind of the handle at about head height (e.g. secured in a door with the attachment device). The tubing should have some tension in it at this position. The arm is rotated to the front (internally rotated) being sure to keep the humerus in 90° abduction and the elbow bent to 90°. The arm is allowed to return to the starting position and the cycle repeated for the recommended number of repetitions and sets. Note: The unique channel feature of the handle hereof allows for the moment arm to be increased, thereby increasing the effective tension and the effective range of motion.

Figure 30A:
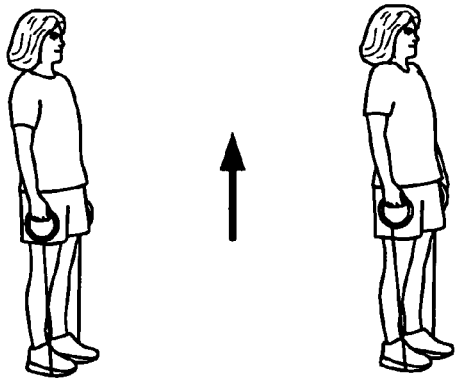
FIG. 30, which includes sub-part FIGS. 30A and 30B, provides a set of exercises performable herewith.

In Shrugs as shown in FIG. 30A, the handles may be set up in stirrup grip position (though channel grips could also/alternatively be used). The handles should be held with the arms at the sides and the hands facing the body. The tubing should project down from the center of the handle in the stirrup grip. The tubing should be secured from a position below the handle (e.g. stepped on). The tubing should have some tension in it at this position. This is the starting point. The user shrugs the shoulders up, keeping the elbows straight and then allows the shoulders to lower to a "shrugged down" position. These motions are repeated for the recommended number of repetitions and sets.

Figure 30B:
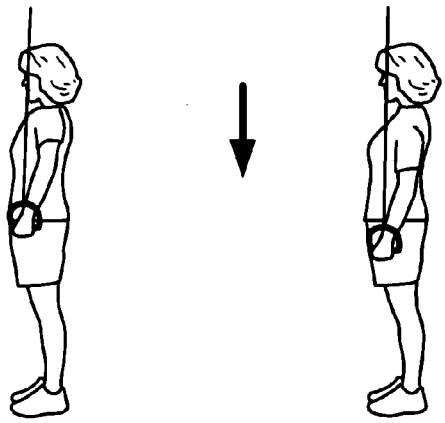

Similar Depression exercises (dual or unilateral) are shown in FIG. 30B, with the handles also set up in the stirrup grip position (again although channel grips could be used). The user may then hold the handles with the arms at the sides and the hands facing the body. The tubing should project up from the centers of the handles. The tubing should be secured from a position above the handle (e.g., secured over a door with the attachment device). The tubing should have some tension in it at this position. This is the starting point. The shoulders are shrugged down, keeping the elbows straight. The shoulders are then returned to a "shrugged up" position and these motions repeated for the recommended number of repetitions and sets.

Figure 31:
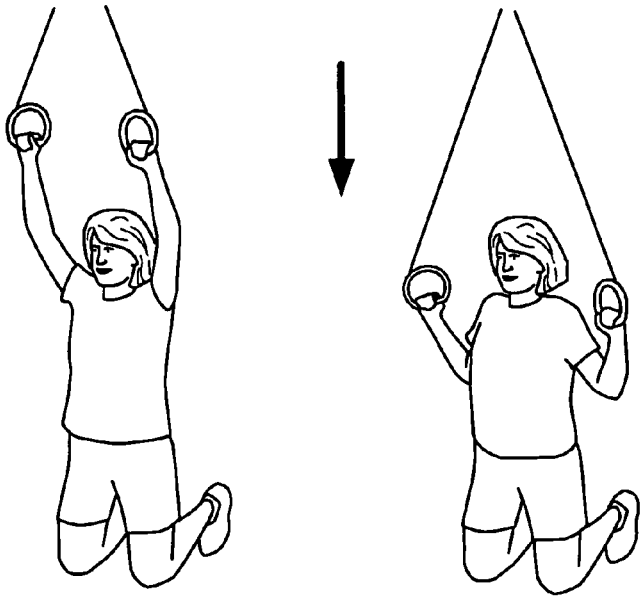
FIG. 31 provides an exercise performable herewith.

For the Lat Pull Down exercise as shown in FIG. 31, the user secures the door attachment to a top anchor as to the top of the door (e.g. secured in a door with a door attachment device) as close to the hinge as possible and connects the door attachment to the tube in the middle of the tube. The user can sit or kneel facing the door or away from it. The exercise begins with the handles over and/or above the head, which the user then lowers to his/her sides, bringing his/her elbows behind the body. The user may then return to the starting position and may then repeat. For such Lat Pull Down exercises, the handles may be set up in the channel grip position. The handles are in some implementations held with the arms held overhead, palms facing forward. The tubing should project up from the channel at the pinky side of the handles (although an alternative inner thumb projection could be used). The user may pull his/her arms down keeping his/her elbows pointed towards the floor also being sure to keep a tight grip on the handles and keep the wrists in neutral (not allowing them to bend). Then is a return to the starting position and repeating for the recommended number of repetitions and sets. Note: The unique channel feature of the handle increases the moment arm and keeps the tubing at an improved vector thereby increasing the effective range of motion and tension during this exercise.

Figure 32E:
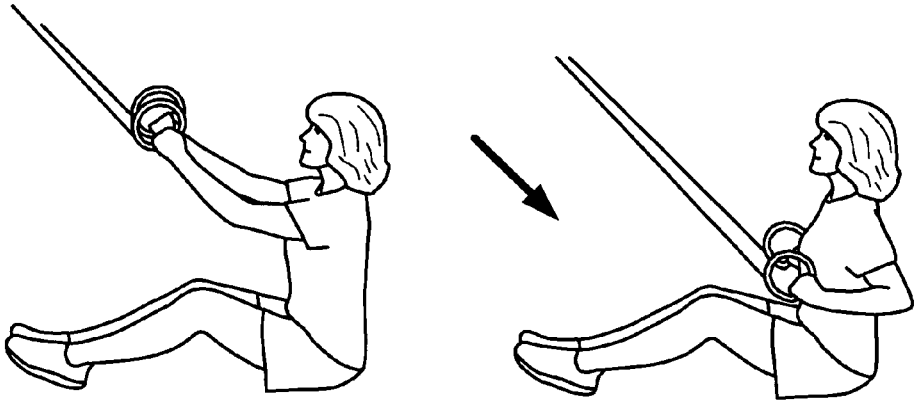
FIG. 32, which includes sub-part FIGS. 32A, 32B, 32C, 32D and 32E, provides a set of exercises performable herewith.
Figure 32A:
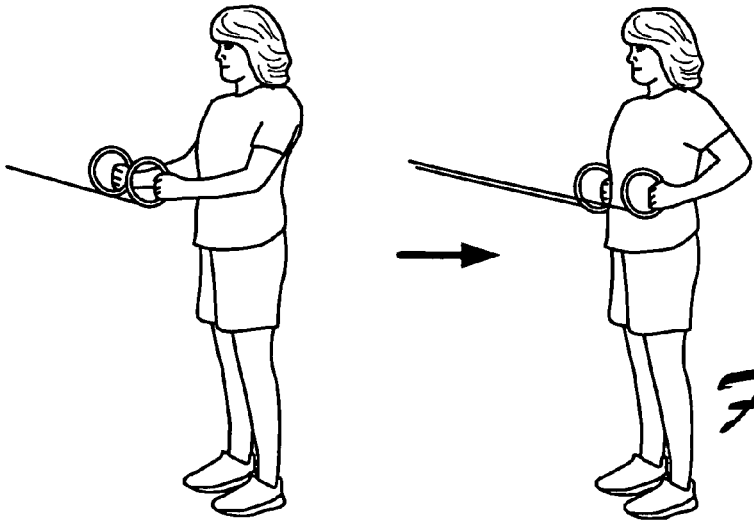

A variety of Rowing exercises may also be performed. In a first basic Rowing example shown in FIG. 32A, the handles are set up in channel grip position with the tubing secured from a position in front of the user at about waist or chest height (e.g. secured at a hinge in a door with a door attachment device). The handles are held with a "thumbs up" position and the tubing projecting out from the channel at the bottom/pinky side of the handles (although an alternative top/thumb side projection could also be used). The arms should be in front of the body with elbows slightly bent and upper arms at the sides. This is the starting point. The tubing should have some tension in it at this position. The elbows are pulled back while squeezing the shoulder blades together down and back. The user should also maintain a slightly downward pressure on the tubing at the pinky side of the handles (unless a top/thumb side channel projection is used), being sure not to move the head or shrug the shoulders upwards. Then is a return to the starting position and a repeat for the recommended number of repetitions and sets. Note: The unique channel feature of the handle hereof allows for the force vector to pull slightly upwards during this exercise (or downwards if a thumb side projection is used), requiring increased activity of the latissimus dorsi.

Figure 32B:
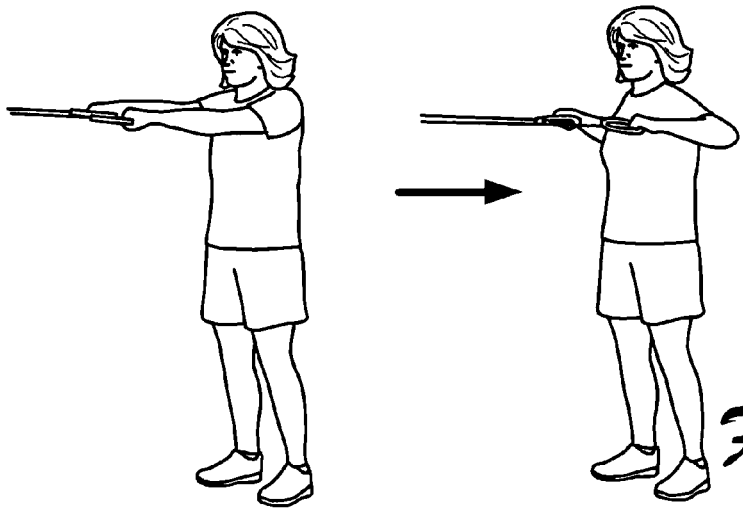
Figure 32C:
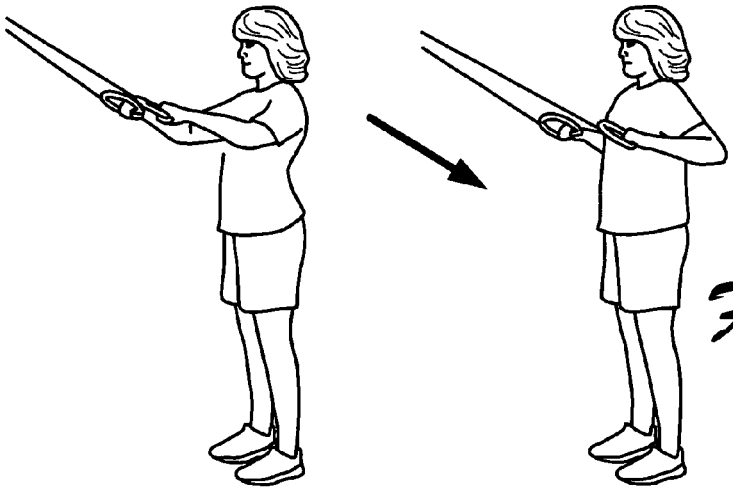
Figure 32D:
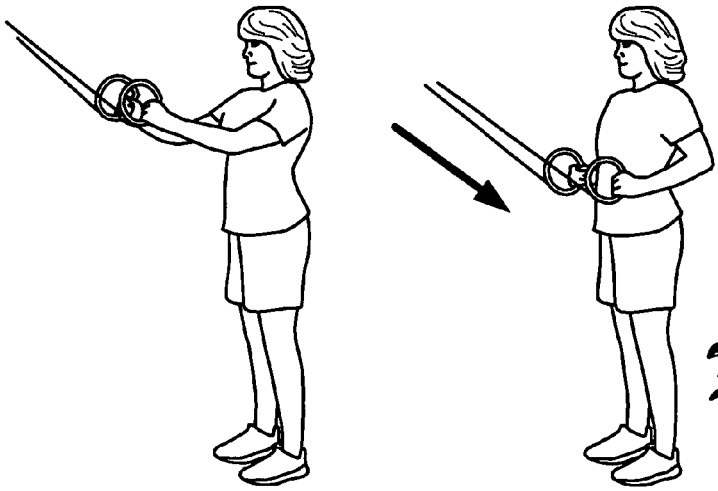

In a second Rowing example (variation A) as shown in FIG. 32B, this exercise is the same as the above-described "Rowing" exercise with the modifications of setting up the handle in any one of the suggested grip positions; holding the handles with palms facing down and using a starting position where the elbows are flared to the sides; i.e., the humerus abducted to about ninety degrees (~90°). In a further Rowing variation (variation B) as shown in FIG. 32C, again, the basic exercise is the substantially the same as the initial "Rowing" exercise (described above) with the modifications of setting the tubing in the door with an attachment at head height (tubing is at ~45° angle with the door) or above; holding the handles with palms facing down and setting the starting position with the elbows flared to the sides, i.e., the humerus abducted to ~45°. A still further Rowing (variation C) as shown in FIG. 32D, yet again, the basic exercise is the same as "Rowing" (see above) with the modification setting the tubing in the door with the attachment at head height (tubing is at ~45° angle with the door) or above. And, in one last Rowing example (variation D) shown in FIG. 32E, the exercise is the same as "Rowing variation C" (see above) with the modification using a seated, long sit position with arms extended to face height.

Abdominal Exercises include crunches, side bends and abdominal twists, inter alia. In FIG. 33A, crunches are shown wherein the tube is attached to a door attachment which is secured to the hinge side of a door, about a foot off the ground. A user positions him/herself away from the door on his/her back. Knees are bent so that the heels are on the floor. The handles are held at eye level beside the head, keeping the lower back pressed into the floor and the back straight. The user curls up using the stomach muscles, and may in some implementations hold for a few seconds and return to starting position and may then repeat.

Figure 33B:
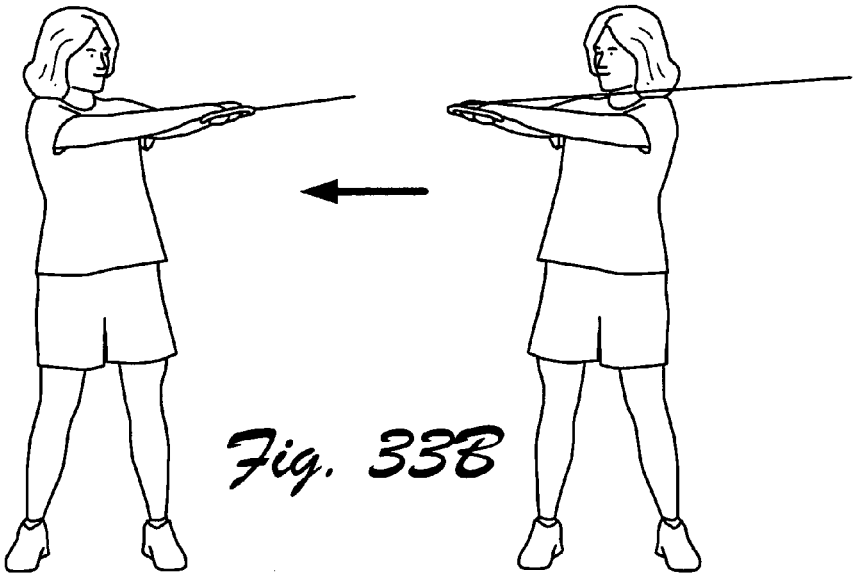
FIG. 33, which includes sub-part FIGS. 33A, 33B, and 33C, provides a set of exercises performable herewith.
Figure 33A:
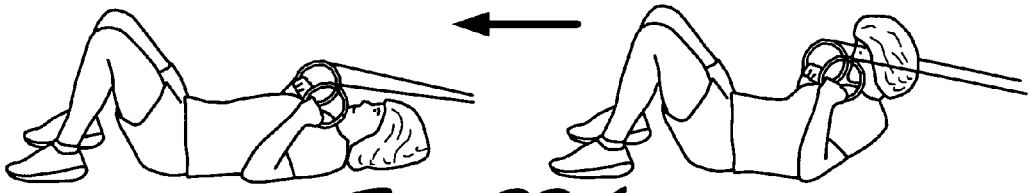
Figure 33C:
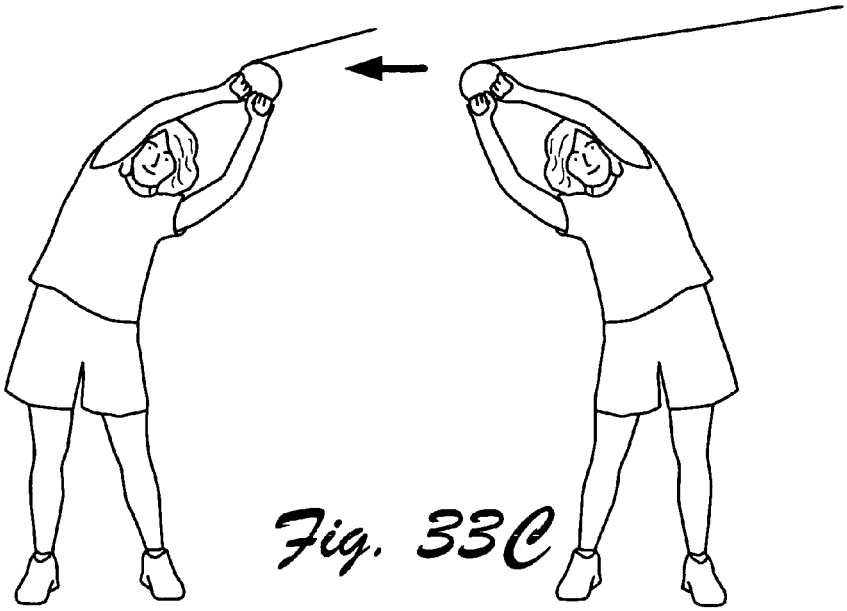

In the Side Bend exercise as shown in FIG. 33C, the door attachment is first secured to an anchor such as in the top of the hinge side of a door. Then, the user holds one handle with both hands directly above the head with a wide, comfortable stance. Keeping the back straight, the user bends at the waist away from the door. Following is a return to the starting position, and then may be a repeat. The user may then turn 180 degrees to exercise the opposite side.

In Abdominal or Ab Twists as shown in FIG. 33B, the door attachment may be secured about shoulder high in the hinge side of door. Standing at a 45-degree angle to the door, the user may grasp the handle with both hands in front, about waist high. The user may then rotate at the waist keeping the hips still. The user then returns to the starting position and may then repeat. The user may then turn 180 degrees to exercise the other side.

Figure 34A:
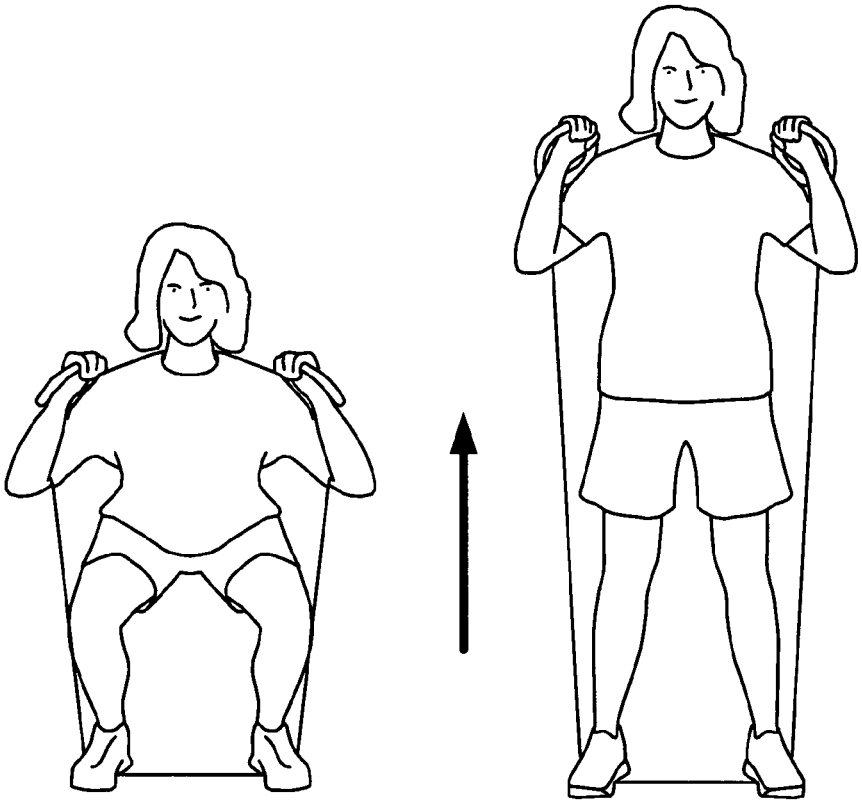
FIG. 34, which includes sub-part FIGS. 34A and 34B, provides a set of exercises performable herewith.

A variety of Lower Body Exercises may also be performed herewith. In the Squat exercise shown in FIG. 34A, the user uses the stirrup grip position (though channels could alternatively be used) of the handles and places both feet on the tube shoulder width apart. The handles are held at shoulder level with palms facing out. The user bends at the knees while keeping the back straight and the chest out. The user lowers him/herself as if he/she were going to sit in a chair until the thighs are parallel to the floor. The user then presses up and may then repeat. The user should not allow the knee to extend past the toe of the foot.

Figure 34B:
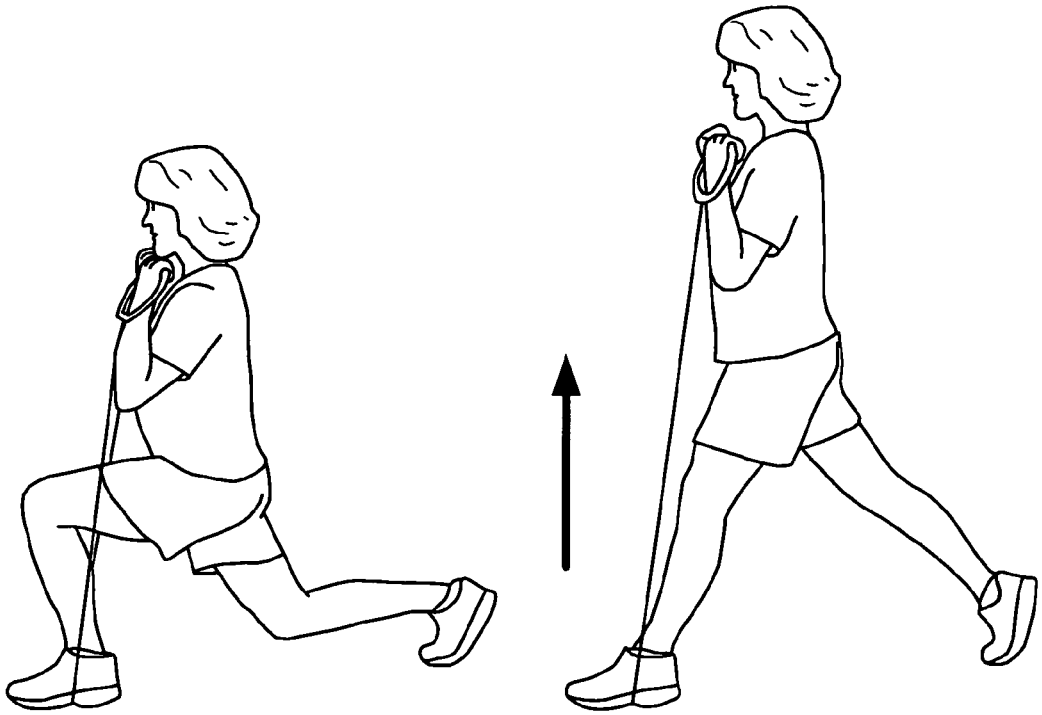

In the Lunge exercise shown in FIG. 34B, The user should stand with one foot on the tube and other slightly behind the body. The handles should be held at shoulder level in front of the body. The user takes a step back and lands on the ball of the foot. The user bends the knees and lowers the body to form a 90-degree angle with the upper and lower portion of each leg. The forward knee should not extend past the toes, and the back should be kept straight. The user then pushes back up to the starting position and may then repeat.

Figure 35:
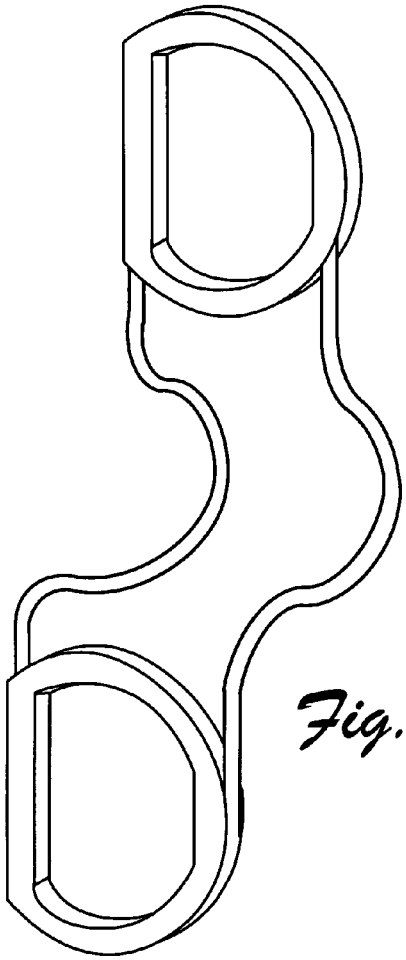
FIG. 35 is an isometric view of an alternative combination device hereof.
Figure 36C:
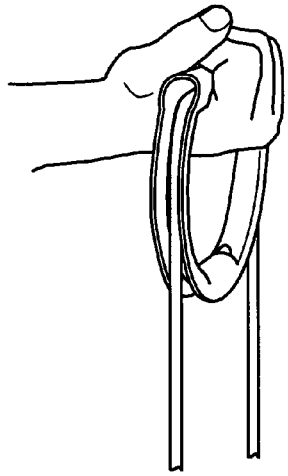
FIG. 36, which includes sub-part FIGS. 36A, 36B and 36C, provides isometric views of alternative uses of a handle hereof.
Figure 36B:
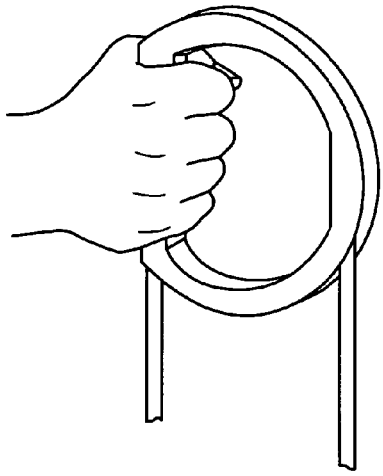
Figure 36A:
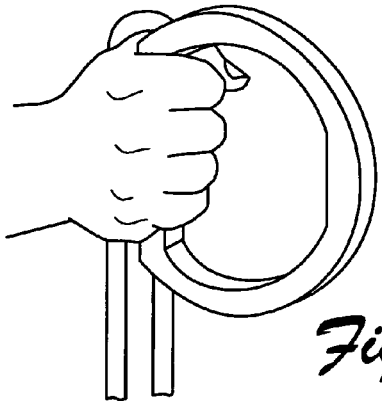

An alternative implementation of two handles hereof is shown in FIGS. 35 and 36, and particularly FIG. 35 with a single substantially continuous loop of a strand of cord or elastic tubing or band (welded to itself or otherwise knotted or secured one end to the other (an example is a cork or like member disposed in first one and then both ends of a hollow elastic tubing member which secures itself around the cork creating a substantially continuous band)). It may be gripped or held as shown in FIG. 36 with either a vertical grip (FIG. 36A), a channel grip (FIG. 36B) or a stirrup grip (FIG. 36C).

Figure 37A:
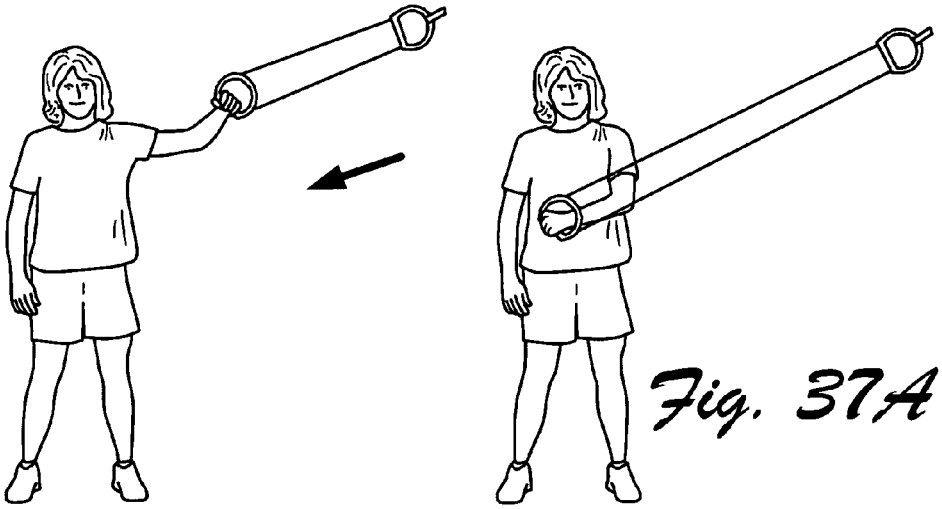
FIG. 37, which includes sub-part FIGS. 37A, 37B, 37C and 37D, provides isometric views of alternative uses of a handle hereof.
Figure 37B:
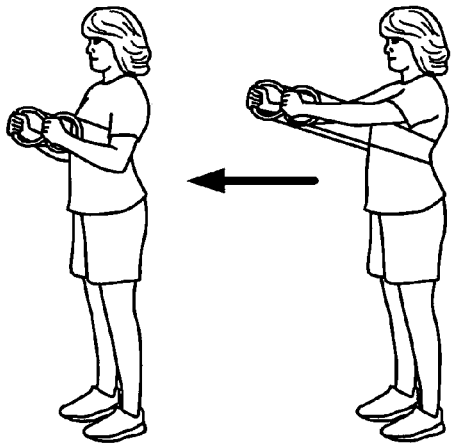
Figure 37C:
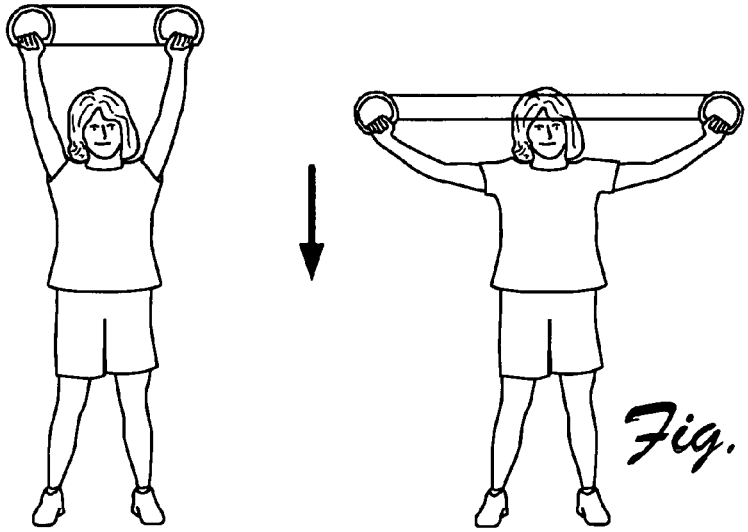
Figure 37D:
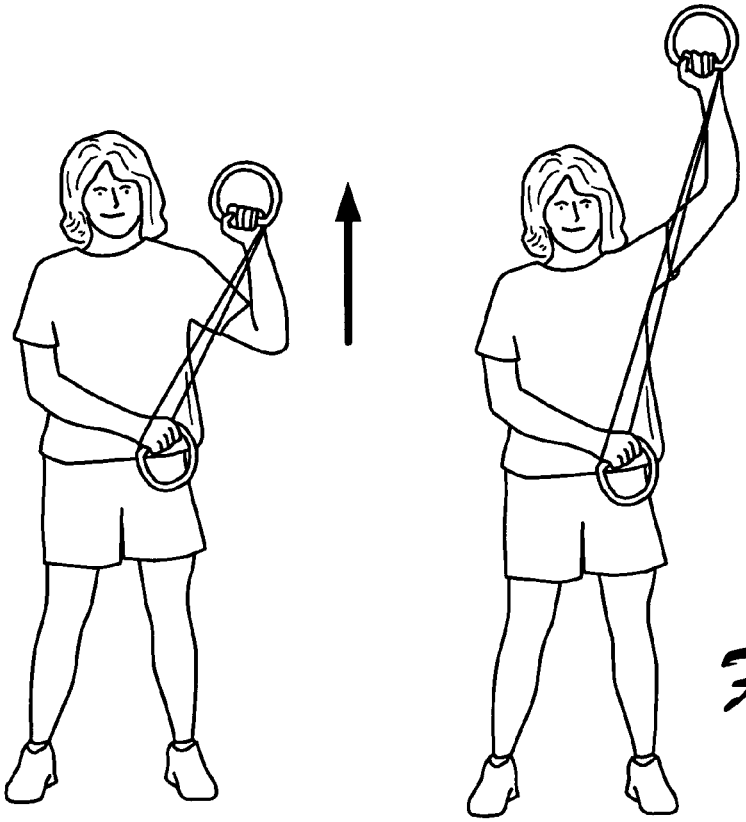

A variety of exercises may be performed with this alternative implementation. A first set of examples includes Upper Body Exercises such as the shoulder press, chest press, lat pulldown and chest crossover. In particular, the Chest Crossover exercise shown in FIG. 37A involves the use of the alternative combination handles secured to the hinge side of a door using a door attachment. The user may then position him/herself relative to the device, e.g., at a 45-degree angle as shown (or horizontally, or at 90 degrees or some other angle) with an arm extended shoulder high. The user's hand is then brought across the body to the opposite hip. A return is made to the original position with then a repeat. In a second upper body example, the Chest Press exercise shown in FIG. 37B involves placement of the combination device tubing behind the user's back, as shown, then having the user press both arms out and then return to original position with repetition as desired. In the Lat Pull Down exercise example shown in FIG. 37C, both handles of such a combination device are held over the user's head. The user pulls both arms down, keeping the elbows slightly bent. The arms are then lowered until they are horizontal to the floor and then returned to the overhead position; then repeated. In the Shoulder Press example shown in FIG. 37D, the user holds one handle waist high and holds the other handle shoulder high as shown. The user then presses the hand shoulder high up to full extension over the user's head with a return to the starting position and repeat. The user then switches hands to exercise the other shoulder.

Figure 38A:
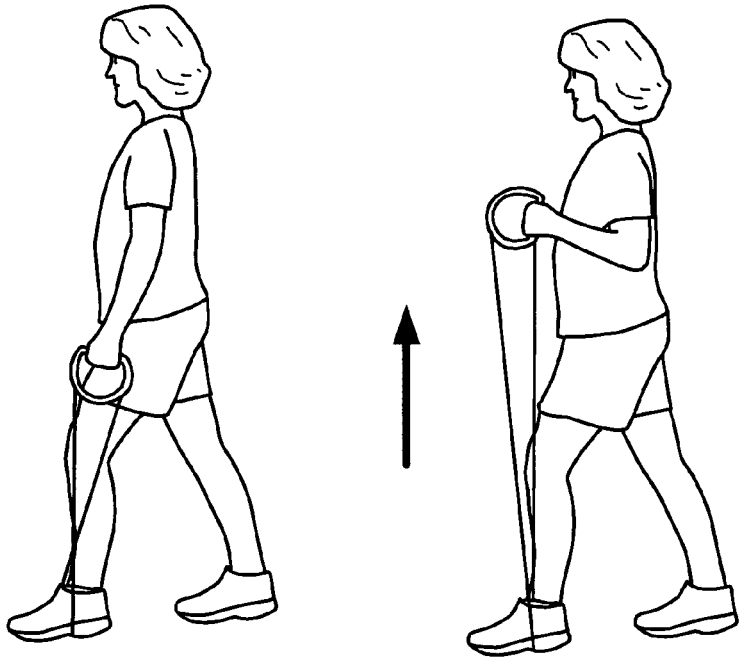
FIG. 38, which includes sub-part FIGS. 38A and 38B, provides isometric views of alternative uses of a handle hereof; and, FIG. 39 provides a use performable herewith.
Figure 38B:
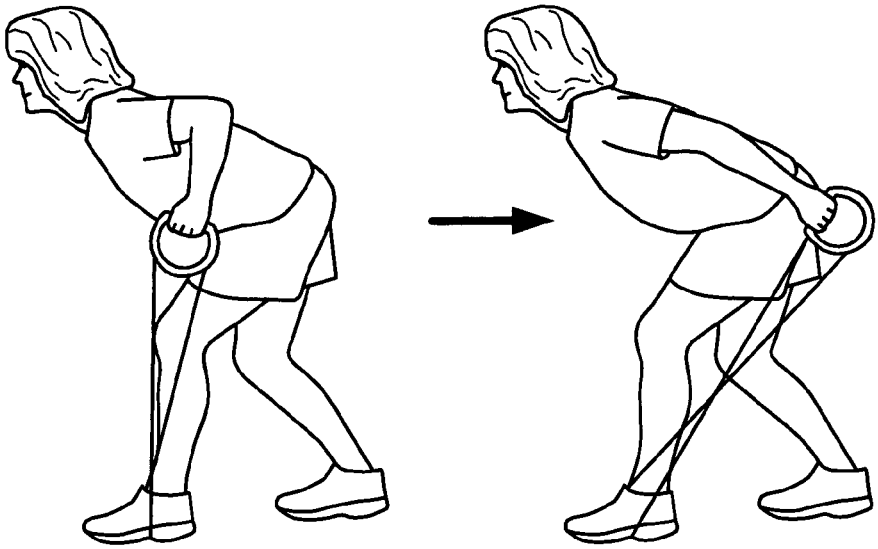
Figure 39:
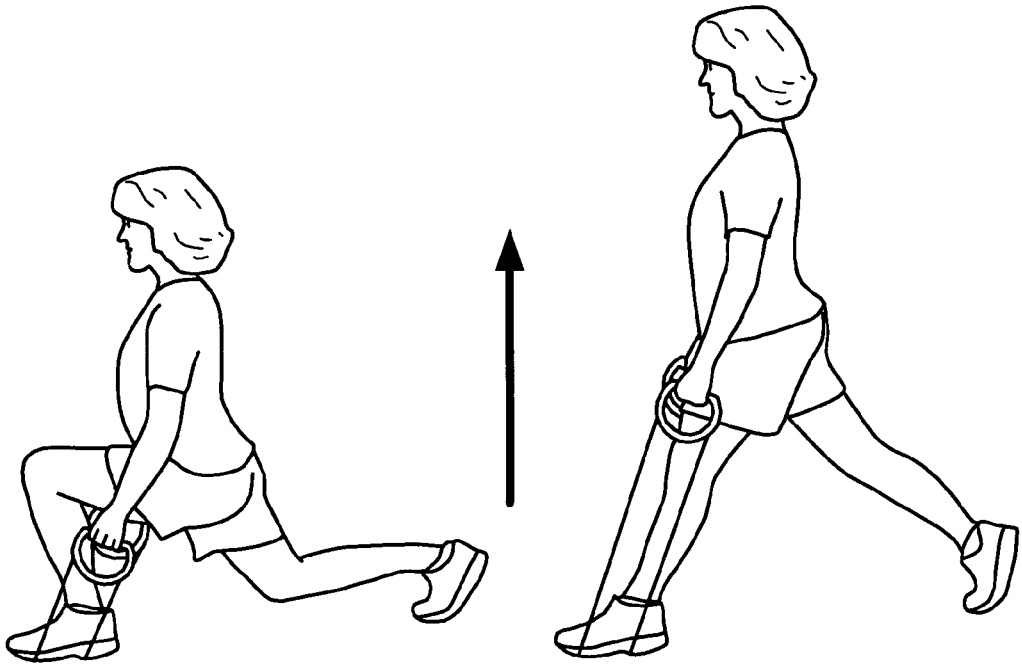

Other examples of exercises performable with this alternative combination device include arm exercises such as curls and triceps presses. In an Arm Hammer Curl exercise as shown in FIG. 38A, the user places one handle securely under one foot, and with the elbow held tightly at the user's side, the arm is curled up to the user's chest, then the arm is lowered to the starting position and repeated as desired. The foot and arm positions may then be reversed to exercise the other arm. In a Triceps Kickback exercise example as shown in FIG. 38B, a first handle is secured under the user's foot and the user bends slightly at the waist. The user then holds the elbow tight to the user's side and extends the arm behind the user's body. A Lower Body Exercise includes the Lunge Stand shown in FIG. 39, where with one foot on both tubes and the other foot slightly behind the user's body, the user then holds the handles at the user's sides. The user then takes a step back and lands on the ball of his/her foot, and bends his/her knees and lowers his/her body to form a 90-degree angle with the upper and lower portion of each leg. The forward knee should not extend past the front toes, and the back should be kept straight. Then, the user pushes back up to starting position and repeats.

As noted in many of the exercises above, a door attachment may be used for attaching the tubing to a door or like anchor. Such a Door Attachment allows for anchoring the tube to a door in a high, mid or low position for exercises. Attach the door attachment to one of the resistance tubes by placing the door attachment around the tube anywhere along the length of the tube and placing the leather doorstop through the loop at the opposite end and pulling tight. Place the leather doorstop over the top or anywhere along the doorjamb next to the hinges. Attach one or two handles to one or each end on the tube in the desired grip set-up. Stand on the side of the door which is pulled upon for closing the door.

Note, for the least amount of resistance, stand on the resistance tube with one foot; for the most resistance, stand on the tubing with both feet, hip width apart. Resistance levels can also be adjusted by lengthening or shortening the tube with the ball lock in the handles. If unable to accomplish minimal repetitions, modify foot placement on the tube or select an Exerciser with a tube that provides a lesser amount of resistance.

The above specification, examples and data provide a complete description of the structure and use of exemplary implementations of the described articles of manufacture and methods. Since many implementations can be made without departing from the spirit and scope of the invention, the invention resides in the claims hereinafter appended.

Furthermore, certain operations in the methods described above must naturally precede others for the described method to function as described. However, the described methods are not limited to the order of operations described if such order sequence does not alter the functionality of the method. That is, it is recognized that some operations may be performed before or after other operations without departing from the scope and spirit of the claims.

What is claimed is:

1. An exercise handle for use with a cord, the handle comprising the following elements in one plane:

a channel portion forming a circular arc with a central angle of greater than 180 degrees, the channel portion having a first channel end and a second channel end positioned non-diametrically relative to each other on the channel portion;

a channel formed on the channel portion, the channel being adapted to receive the cord and having a channel opening facing outwardly along the channel portion;

a grip portion having a first grip portion end and a second grip portion end, wherein the first grip portion end is connected to the first channel end and the second grip portion end is connected to the second channel end, thus connecting the at least two channel portion ends and having a length less than a diameter of the circular arc, wherein the first grip portion end and the second grip portion end merge with the first channel end and the second channel end, respectively, along the circular arc.

2. An exercise handle as in claim 1 wherein the grip portion has a hollow portion for receiving the cord to be locked therein.

3. An exercise handle as in claim 2 wherein the hollow portion is defined in and through the grip portion along the length thereof.

4. An exercise handle as in claim 2 wherein the hollow portion is defined in and through the grip portion perpendicular to the length thereof.

5. An exercise handle as in claim 1 wherein the channel is defined by two channel lips and a concave internal channel surface.

6. An exercise handle as in claim 1 wherein the channel portion has one or more holes defined therein.

7. An exercise handle as in claim 6 wherein the one or more holes are used for provision of a stirrup grip.

8. An exercise handle as in claim 1 wherein the grip portion has a floating member disposed thereon.

9. The exercise handle of claim 1, wherein the grip portion is substantially cylindrical.

10. The exercise handle of claim 2, wherein the channel portion extends into the hollow portion of the grip portion.

11. The exercise handle of claim 1, wherein the grip portion is hollow, and wherein the channel portion and the grip portion form an aperture for receiving the cord to be locked therein.

12. An exercise handle for use with a cord, the handle comprising the following elements in one plane:

a channel portion forming a circular arc with a central angle of greater than 180 degrees, the channel portion having a first channel end and a second channel end positioned non-diametrically relative to each other on the channel portion;

a channel formed on the channel portion, the channel being adapted to receive the cord and having a channel opening facing outwardly along the channel portion;

a grip portion having a first grip portion end and a second grip portion end, wherein the first grip portion end is connected to the first channel end and the second grip portion end is connected to the second channel end, thus connecting the at least two channel portion ends and having a length less than a diameter of the circular arc; and a cord lock comprising a ball portion that engages the cord inside an aperture formed by an interface between the channel portion and the grip portion of the exercise handle in a frictional manner to lock the cord in the aperture relative to the handle.

13. The exercise handle of claim 12, wherein the ball portion has a textured portion.

14. The exercise handle of claim 13, wherein the textured portion includes one or more grooves, roughened surfaces, dimples, raised surfaces, protrusions or indented surfaces.

15. The exercise handle of claim 12 wherein the ball portion shape is one of spherical, cubical, frusto-pyramidal, frusto-conical or an irregular shape.

16. The exercise handle of claim 1 wherein the channel is of uniform depth along the circumference of the channel portion.

17. The exercise handle of claim 1 wherein the channel is of non-uniform depth along the circumference of the channel portion.

18. The exercise handle of claim 1 wherein the depth of the channel exceeds the diameter of the cord.

19. The exercise handle of claim 1 wherein the grip portion has a textured surface.

20. The exercise handle of claim 19 wherein the textured surface includes one or more grooves, roughened surfaces, dimples, raised surfaces, protrusions or indented surfaces.

21. The exercise handle of claim 1 wherein the grip portion is sized to accommodate four fingers of a human hand gripping the grip portion of the exercise handle.

22. The exercise handle of claim 1 wherein the channel interior surface is angular or ribbed.

23. An exercise handle for use with a cord, the handle comprising the following elements in one plane:

a channel portion forming a circular arc with a central angle of greater than 180 degrees, the channel portion having a first channel end and a second channel end positioned non-diametrically relative to each other on the channel portion;

a channel formed on the channel portion, the channel being adapted to receive the cord and having a channel opening facing outwardly along the channel portion;

a grip portion having a first grip portion end and a second grip portion end, wherein the first grip portion end is connected to the first channel end and the second grip portion end is connected to the second channel end, thus connecting the at least two channel portion ends and having a length less than a diameter of the circular arc; and a cord, wherein the cord is an elastic resistance element.

24. An exercise handle as in claim 23 wherein the elastic resistance element is one or more of a tube, surgical-type tubing, rubber band or bungee cord.

25. An exercise handle for use with a cord, the handle comprising the following elements in one plane:

a channel portion forming a circular arc with a central angle of greater than 180 degrees, the channel portion having a first channel end and a second channel end positioned non-diametrically relative to each other on the channel portion;

a channel formed on the channel portion, the channel being adapted to receive the cord and having a channel opening facing outwardly along the channel portion;

a grip portion having a first grip portion end and a second grip portion end, wherein the first grip portion end is connected to the first channel end and the second grip portion end is connected to the second channel end, thus connecting the at least two channel portion ends and having a length less than a diameter of the circular arc; and a cord, wherein the cord is a chain, cable, rope, or non-elastic material element.

26. An exercise handle as in claim 23 wherein a distal end of the cord may be anchored to one or more of a spring, a movable weight, a pulley or a stationary anchor.

27. An exercise handle as in claim 25 wherein a distal end of the cord may be anchored to one or more of a spring, a movable weight, a pulley or a stationary anchor.

* * * * *